United States Patent [19]

Eguchi et al.

[11] Patent Number: 4,741,976

[45] Date of Patent: May 3, 1988

[54] ELECTROLUMINESCENT DEVICE

[75] Inventors: Ken Eguchi, Yokohama; Haruki Kawada, Kawasaki; Yukuo Nishimura, Sagamihara, all of Japan

[73] Assignee: Canon Kabushiki Kaisha, Tokyo, Japan

[21] Appl. No.: 20,173

[22] Filed: Feb. 27, 1987

Related U.S. Application Data

[63] Continuation of Ser. No. 759,892, Jul. 29, 1985, abandoned.

[30] Foreign Application Priority Data

Jul. 31, 1984 [JP] Japan ..... 59-158825
Jul. 31, 1984 [JP] Japan ..... 59-158826

[51] Int. Cl.[4] ..... H01J 1/62

[52] U.S. Cl. ..... 428/690; 428/691; 428/917; 313/503; 313/504

[58] Field of Search ..... 313/503, 504; 428/690, 428/691, 917

[56] References Cited

U.S. PATENT DOCUMENTS 3,172,862 3/1965 Gurnee et al. .
3,173,050 3/1965 Gurnee ..... 313/504
3,359,445 12/1967 Roth .
3,382,394 5/1968 Mehl ..... 313/504
3,621,321 11/1971 Williams et al. ..... 313/504
3,710,167 1/1973 Dresner et al. ..... 313/504
3,995,299 11/1976 Partridge ..... 313/504 X
4,356,429 10/1982 Tang ..... 313/503
4,539,507 9/1985 Van Slyke et al. ..... 313/504
4,542,712 9/1985 Sato et al. .

FOREIGN PATENT DOCUMENTS 0125278 11/1978 Japan ..... 428/917

OTHER PUBLICATIONS

Engler, et al., "New Electrochemical Flouresant Display Material with Memory", IBM Technical Disclosure Bulletin, 22, Jul. 1978.

Allan, "Atoms Add Luster to Electroluminescence", *Electronics*, Review, 53, pp. 42–44, May 22, 1980.

*Primary Examiner*—Nancy A. B. Swisher

*Attorney, Agent, or Firm*—Fitzpatrick, Cella, Harper & Scinto

[57] ABSTRACT

An electroluminecent device comprises a pair of electrodes, two luminescent layers provided between the pair of electrodes, and an electrode provided between the two luminescent layers, at least one of said two luminescent layers having a layer comprising a monomolecular film of an organic compound or a built-up film thereof.

50 Claims, 2 Drawing Sheets

ELECTROLUMINESCENT DEVICE

This application is a continuation of application Ser. No. 759,892, filed July 29, 1985, now abandoned.

BACKGROUND OF THE INVENTION

1. Field of the Invention

This invention relates to an electroluminescent device [EL device], particularly to an EL device having two independent luminescent layers, which can individually be controlled to control freely the tone of the luminescent color, intensity, etc. and simultaneously has a sufficient luminance.

2. Description of the Prior Art

EL device generally has a structure, comprising a luminescent layer containing a material having EL function, namely a material having the function of emitting light when placed in an electrical field, arranged between two electrodes, and it is a luminescent device which emits light by directly converting electric energy to light by applying voltage between these electrodes to generate an electrical field. It is different from a light emitting system of the prior art, for example, an incandescent lamp in which filament is heated to emit light or a fluorescent lighting in which an electrically excited gas imparts energy to a fluorescent material to effect emission, and it is attracting attention because of having the possibility of being realized as constituent member for lamps, displaying medium to be used for display of lines, figures and images, of various shapes such as thin panels, belts, cylinders, etc., or panel lamps, etc. of larger area.

As the material having EL function to be used for EL device, there have been used in the prior art primarily inorganic metal materials such as ZnS, etc. containing Mn, Cu or $ReF_3$ (Re represents a rare-earth element) as the activator. Also, recently, as shown by the EL device employing anthracene, pyrene or perylene or derivatives thereof as the material for luminescent layer disclosed in Japanese Laid-open Patent Publication No. 172891/1983, organic compound materials capable of forming thin films with good precision according to various thin film forming techniques are attracting attention.

The color of the light emitted from such an EL device can be controlled primarily by combining suitably selected materials to be used for luminescent layer or changing the intensity of the electrical field.

However, when an EL device is formed by use of the materials capable of forming the luminescent layer, the color and intensity of luminescence are limited to some extent, and it has been most difficult to change greatly the luminescent color, control severely the tone or control freely the intensity of luminescence in one EL device.

On the other hand, when a so-called thin film type EL device is produced by formation of a thin film luminescent layer according to the thin film forming method such as vapor deposition by use of the above inorganic metal material comprising mainly ZnS, there is involved the problem that the production cost is very high, and also no EL device of good quality having a large area could be produced with good bulk productivity, because a luminescent layer of large area comprising a uniform thin film could be formed only with extreme difficulty.

In contrast, as an EL device enriched in bulk productivity and advantageous in cost, an organic powder type EL element of the intrinsic EL system, comprising a luminescent layer formed by dispersing the above EL inorganic material composed mainly of ZnS in an organic binder, has been known.

However, in this powder type El device, when the layer thickness is made thinner, defects such as pinholes, etc. will readily be formed in the luminescent layer and therefore the layer thickness of the luminescent layer can be made thinner to a limited extent in its structure for the purpose of enhancing sufficiently the luminescent characteristic, whereby no sufficient luminescence, particularly luminance can be obtained. Also, due to the relatively thick layer thickness, there is also involved the problem of greater power consumption for generation of stronger electrical field. For generation of strong electrical field within the luminescent layer possessed by such a powder type EL device, an improved type powder EL device provided with an intermediate dielectric layer comprising vinylidene fluoride copolymer has been known, as disclosed in Japanese Laid-open Patent Publication No. 172891/1983, but under the present situation, no satisfactory performance with respect to luminance, power consumption, etc. has yet been obtained.

Also, in the EL device employing an organic material such as anthracene, etc., although the luminescent layer can be formed as a thin film with good precision, the density of electrons or holes which are carriers is very small, whereby excitation probability of functional molecules through migration or recombination of carriers is so low as to give no efficient luminescence. Particularly, it is unsatisfactory in power consumption and luminance under the present situation.

SUMMARY OF THE INVENTION

An object of the present invention is to provide a novel EL device having a structure capable of changing greatly the luminescent color, controlling severely the tone or controlling freely the intensity of luminescence in one EL device.

Another object of the presence invention is to provide a novel EL device having a structure, which can be formed by selecting suitably various materials for EL device in combination with a thin film forming method optimal for such materials selected, has good luminescent efficiency, can give sufficient luminance even by low voltage driving and can be produced easily at low cost.

According to the present invention, there is provided an EL device, comprising a pair of electrodes two luminescent layers provided between the pair of electrodes and an electrode layer provided between the two luminescent layers, at least one of said two luminescent layers having a layer comprising a monomolecular film of an organic compound or a built-up film thereof.

At least one electrode of the pair of electrodes may be transparent. The electrode between the two luminescent layers may be transparent or translucent.

DETAILED DESCRIPTION OF THE PREFERRED EMBODIMENTS

The EL device of the present invention, having a structure comprising two independent luminescent layers laminated between a pair of electrode layers can change the color, tone or intensity of luminescence by controlling individually the respective luminescent layers as desired, and can also effect luminescence having sufficient luminance.

Referring now to the accompanying drawings, an embodiment of the EL device of the present invention is described in detail.

Figure 1:
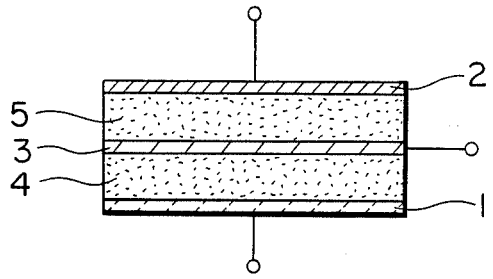
FIG. 1 is a schematic sectional view of an EL device of the present invention.

FIG. 1 shows a schematic sectional view of the EL device of the present invention.

1, 2 and 3 are electrode layers for generating an electrical field by application of voltage, and 1 is a transparent electrode layer from which the lights generated at the luminescent layer 4 and the luminescent layer 5 are taken out in combination. 4 and 5 are luminescent layers having EL function, the luminescent layer 4 emitting light by the electrical field generated by the electrode layers 1 and 3, the luminescent layer 5 emitting light by the electrical field generated by the electrode layers 2 and 3. Thus, the electrode layer 3 is the common electrode for both luminescent layers 4 and 5, having the function of transmitting the light generated at the luminescent layer 5 to the luminescent layer 4 side, and it may either be a transparent layer or a translucent layer which can transmit the light primarily to only the luminescent layer 4 side.

In one embodiment of the EL device of the present invention shown in FIG. 1, the electrode layer 1 is provided as a transparent electrode, but alternatively, only the electrode layer 2 or both of these two electrode layers may be transparent. When only the electrode layer 2 is transparent, the electrode layer 3 is provided so as to have a function to transmit the light at least from the luminescent layer 4 to the luminescent layer 5 side. On the other hand, when both of the electrode layer 1 and the electrode layer 2 are transparent, the electrode layer 3 is provided so as to transmit the light from the luminescent layer 4 to the luminescent layer side 5 and also in the direction opposite thereto.

The luminescent layer 4 and the luminescent layer 5 may have the same function, or alternatively different functions, different in, for example, luminescent color or luminance.

In the following, the basic structures of the luminescent layer 4 and the luminescent layer 5 possessed by the EL device of the present invention are explained.

The luminescent layers 4 and 5 have a first layer containing an organic compound exhibiting primarily relatively electron-acceptable property, a second layer containing an organic compound exhibiting primarily relatively electron-donative property and a third layer having electrical insulating property, and it is constituted to have a basic structure in which the above first layer, the second layer and the third layer are laminated in this order in at least two repeated laminations on the above third layer. And, of the first layer, the second layer and the third layer possessed by either one or both of the luminescent layer 4 and the luminescent layer 5, at least one layer is formed of a monomolecular film or built-up monomolecular films of an organic compound capable of forming said layer.

That is, the luminescent layer possessed by the EL device of the present invention has a structure in which an organic compound exhibiting relatively electron-acceptable property (hereinafter abbreviated as EA compound) and an organic compound exhibiting relatively electron-donative property (hereinafter abbreviated as ED compound) are positioned so as to contact each other, and has the luminescent action based on formation excited complex accompanied with giving and receiving electrons between these compounds when they are placed in an electrical field as the luminescent source, and yet has a structure suitable for efficient formation of such excited complex with generation of an electrical field.

Figure 2:
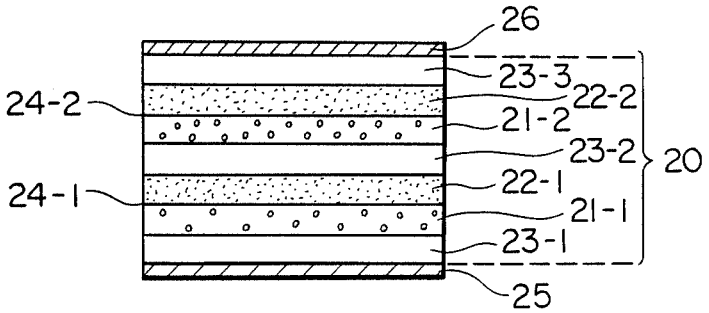
FIG. 2 is a schematic sectional view of an example of the luminescent layer possessed by the EL device of the present invention.

An example of such a structure is shown in a schematic sectional view of FIG. 2.

25 and 26 are electrode layers for generation of an electrical field by application of voltage, and 20 is a luminescent layer having EL function. Of the electrode layers shown in FIG. 2, the electrode layer 25 corresponds to the electrode layer 3 in the EL device of the present invention as shown in FIG. 1, and the electrode layer 26 corresponds to the electrode layer 1 or 2 in said EL device, respectively.

The luminescent layer 20 is constituted of a multilayer structure, having the first layers 21-1, 21-2, the second layers 22-1, 22-2 and the third layer 23-2 laminated in alternately repeated fashion between the third layers 23-1 and 23-3 functioning as insulating layers laminated at both upper and lower ends, at least one of the first layers 21-1, 21-2, the second layers 22-1, 22-2 and the third layers 23-1, 23-2, 23-3 being formed of a monomolecular film or its built-up film of an organic compound capable of forming said layer.

The first layer 21-1 possessed by the luminescent layer contains a compound which can be an EA compound relative to the ED compound as described above contained primarily in the second layer 22-1, the second layer 22-1 laminated in direct contact with the first layer 21-1 contains a compound which can be an ED compound relative to the EA compound contained primarily in the first layer 21-1, and the interface between the first layer 21-1 and the second layer 22-1 forms the contact surface between the EA compound and the ED compound. The relationship between the first layer 21-2 and the second layer 22-2 is similar to this, thus forming independently an interface 24-2 by these layers.

In these interfaces 24-1, 24-2, when an electrical field is applied on the luminescent layer 20 by application of voltage on electrodes across the electrodes 25, 26, the EA compound and the ED compound will form a complex under excited state, and excitation energy is generated as light from the complex under excited state, the EA compound and/or the ED compound when the excited complex returns to the ground state. Thus, luminescence in the EL device of the present invention utilizes the luminescence at the interfaces 24-1 and 24-2 as the luminescent source.

The first layers 21-1, 21-2 and the second layers 22-1, 22-2 constituting the luminescent layer possessed by the EL device of the present invention contain compound molecules participating directly in formation of complexes excited by electrical field as shown below or compound molecules having at least one of said compound molecules as the functional moiety.

As the arrangement of the compound molecules participating directly in formation of complexes excited by electrical field within the luminescent layer 20, the following combinations may be mentioned as representative ones:

(a) compound molecules having EL function (primarily to effect luminescence) based on formation of excited complexes are arranged in each of the first layers 21-1, 21-2 and the second layers 22-1, 22-2;

(b) compound molecules having EL function based on formation of excited complexes are arranged in the first layers 21-1, 21-2, and compounds which can be electron donors relative to these compounds (ED compounds) are arranged in each of the second layers 22-1, 22-2;

(c) compound molecules having EL function based on formation of excited complexes are arranged in the second layers 22-1, 22-2, and compounds which can be electron acceptors relative to these compounds (EA compounds) are arranged in each of the first layers 21-1, 21-2.

As the compound having EL function based on formation of excited complex as mentioned above, there may suitably be employed an organic compound, having a high luminescent quantum efficiency, having a $\pi$ electron system susceptible to external perturbation, which can readily be excited by an electrical field.

Such compounds may include fused polycyclic aromatic hydrocarbon, p-terphenyl, 2,5-diphenyloxazole, 1,4-bis(2-methylstyryl)benzene, xanthine, coumarin, acridine, cyanine dye, benzophenone, phthalocyanine and metal complex thereof, porphyrine and metal complex thereof, 8-hydroxyquinoline and metal complex thereof, ruthenium complex, rare earth complex and derivatives of these compounds, as well as other heterocyclic compounds and derivatives thereof, aromatic amines, aromatic polyamines, compounds having quinone structure, which have EL function based on formation of excited complexes. By combining at least one compound which can be relatively an EA compound and at least one compound which can be relatively an ED compound selected as desired from among these compounds, and applying suitably the thin film forming method such as the vapor deposition method, CVD method or the monomolecular built-up method as hereinafter described, the luminescent layer having the constitution (a) of the first layer and the second layer as mentioned above can be formed.

Further, as the compound which can be an electron acceptor or an electron donor relative to the compound having EL function base on formation of excited complex as mentioned above, there may be employed heterocyclic compounds and derivatives thereof, aromatic amines, aromatic polyamines, compounds having quinone structure other than those set forth above, tetracyanoquinodimethane and tetracyanoethylene. By combining suitably the compounds as previously mentioned with these compounds, the luminescent layer having the constitution (b) or (c) of the first layer and the second layer as mentioned above can be formed.

The compound capable of forming the functional moiety as mentioned above may also have a function to effect luminescence not based on formation of excited complex, and luminescence in the EL device of the present invention is not limited to the luminescence at the interfaces 24-1, 24-2 between the first layer and the second layer, but also inclusive of the case in which luminescence is effected also in the first layers 21-1, 21-2 and/or the second layers 22-1, 22-2.

Also, the first layers 21-1, 21-2 may also contain other components, in addition to EA compound, which can enhance the efficiency of electrical field excitation of EA compound through electrochemical interaction with said EA compound, control luminescent color, etc., increase the strength of the first layers or improve adhesion with other layers. As to the second layers, these compounds other than ED compounds may also similarly be contained. The compounds other than EA compounds and ED compounds may also have themselves EL function.

As the compound which can enhance efficiency of electrical field excitation of EA compound through electrochemical interaction with EA compound or ED compound, there may be employed a compound which is an electron acceptor or can be an electron acceptor relative to EA compound or a compound which is an electron donor or can be an electron donor relative to ED compound.

Such compounds may include compounds having EL function (primarily to effect luminescence) based on formation of excited complex as mentioned above, compounds which can be electron donors or electron acceptors relative to said compounds, compounds which can be luminescent material through excitation energy shift and compounds having at least one of these compound molecules as the functional moiety. Upon formation of the first layer and the second layer, at least one of these compounds may be suitably selected depending on the compounds (EA compound and ED compound) to be used as the main components in the first layer and the second layer.

The amount of such compounds to be mixed into the first layer and/or the second layer may differ depending on the compounds to be used in the first layer and the second layer and therefore cannot be defined commonly for all the cases, but the compound to be contained in the first layer which can be an electron acceptor or an electron donor relative to EA compound may be contained at a proportion of 10 mol % to 0.1 mol % based on EA compound, while the compound to be contained in the second layer which can be an electron acceptor or an electron donor relative to ED compound may be about 10 mol % to 0.1 mol % based on ED compound.

For formation of at least one layer of the first layers 21-1, 21-2 and the second layers 22-1, 22-2 as a monomolecular film or built-up molecular films of a compound capable of constituting said layer, the so-called monomolecular built-up method is preferably applicable, which enables a high orderly molecular orientation and arrangement to form simply an ultra-thin film layer.

This monomolecular built-up method is based on the following principle. That is, for example, in molecules with a structure having a hydrophilic group and a hydrophobic group in the molecule, when the balance between the both groups (amphiphilic balance) is adequately maintained, a large number of such molecules will form a layer of monomolecules with the hydrophilic group pending downward on the water surface. The monomolecular layer on the water surface has the characteristics of a two-dimensional system. When the molecules are spread sparsely, between the area per one molecule and the surface pressure II, the formula of the two-dimensional ideal gas:

$$\Pi A = kT$$

is valid (where k is the Boltzman's constant and T is the absolute temperature). While these molecules form a "gaseous film", if A is made sufficiently small, the interaction between the molecules will be strengthened to make the film a "condensed film (or solid film)". The condensed film can be transferred onto the surface of a substrate such as glass, etc., and an ultra-thin monomolecular film or its built-up film can be formed on the substrate.

According to this method, the directions in which the molecules for forming the monomolecular film may be made uniform within one monomolecular film, as exemplified by a high orderly orientation of substantially all the hydrophilic moieties of the constituent molecules toward the substrate side. Accordingly, by forming the first layer and/or the second layer in the EL device of the present invention as a monomolecular film or built-up monomolecular films, it is rendered possible to arrange the functional moieties comprising compound molecules participating directly in formation of excited complexes contained in the layer formed as the monomolecular film or the built-up monomolecular films at a high density at the interface between the first layer and the second layer.

As the solution for formation of monomolecules in the monomolecular built-up method, various solutions may be available, and depending on the solution employed, compounds for formation of monomolecular film having well-balanced moieties different in affinity for said solution can be selected appropriately to form monomolecular films. Among such solutions for formation of monomolecular films, water and aqueous solutions composed mainly of water may preferably be used in view of its low cost, easiness in handling as well as safety.

Referring now to an example in which the monomolecular built-up method using water or a solution mainly composed of water is applied, the constitution of the luminescent layer in the EL device of the present invention is described.

Figure 3:
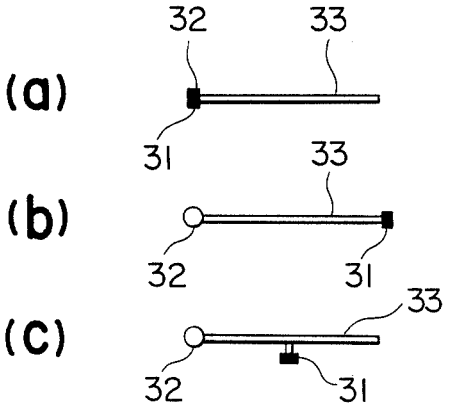
FIG. 3 is a schematic illustration of the molecular structure of the compound for formation of a monomolecular film.

Basically, the compound capable of forming the first layer and the second layer possessed by the luminescent layer in the EL device of the present invention is a compound capable of forming the functional moiety as described above or a compound having at least one of said compound molecules as the functional moiety. Of these compounds, those capable of forming a monomolecular film or built-up monomolecular films, when taking an example of the compounds having one functional moiety, may be classified broadly into the three types depending on the position having the functional moiety in the molecule, as shown in the schematic illustration of the molecular structure shown in FIG. 3, namely:

(a) the functional moiety 31 exists on the hydrophilic portion 32 side—FIG. 3(*a*);

(b) the functional moiety 31 exists on the hydrophobic portion 33 side—FIG. 3(*b*); and (c) the functional moiety 31 exists at approximately the middle between the hydrophobic portion 33 and the hydrophilic portion 32—FIG. 3(*c*).

As the constituent element of the hydrophilic portion 32 of these compounds, there may be included, for example, carboxyl group and its metal salt, amine salt and ester, sulfonic acid group and its metal salt and amine salt, sulfonamide group, amide group, amino group, imino group, hydroxyl group, quaternary amino group, oxyamino group, oxyimino group, diazonium group, guanidine group, hydrazine group, phosphoric acid group, silicic acid group, aluminic acid group, etc., and each or a combination of these groups can constitute the hydrophilic portion 32 in the above compound.

On the other hand, the constituent element of the hydrophobic portion 33 may include groups exhibiting hydrophobic property such as straight or branched alkyl group, olefinic hydrocarbon such as vinylene, vinylidene, acetylene, etc., phenyl, fused polycyclic phenyl such as naphthyl, anthranyl, etc., chain polycyclic phenyl such as biphenyl, etc., and each or a combination of thesse groups can constitute the hydrophobic portion 33 in the above compound.

Figure 4:
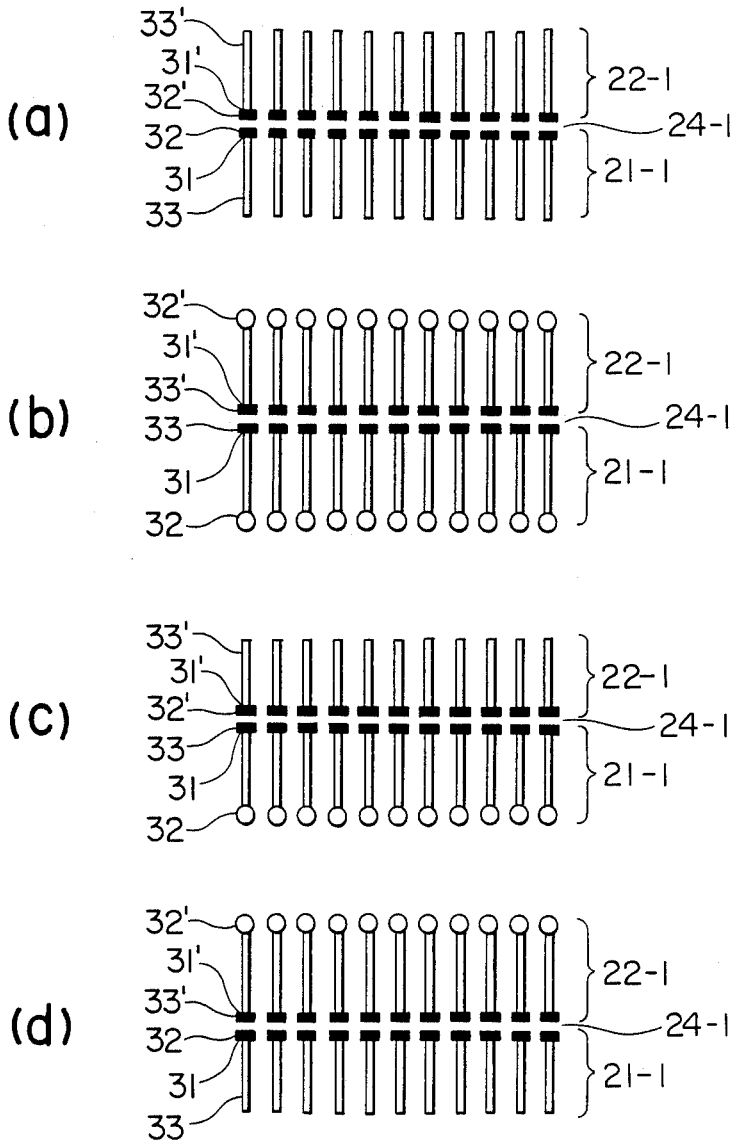
FIG. 4 is a schematic illustration showing the arrangement of molecules at the interface of the first layer and the second layer possessed by the EL device.

On the other hand, the orientation and arrangement of the monomolecular films at the interfaces 24-1, 24-2 (the portion where luminescence is effected primarily) between the first layer and the second layer of the luminescent layer in the EL device of the present invention may be classified basically into the following four patterns, as shown in the schematic sectional partial view around the interface 24-1 in FIG. 4 (in the case of this Figure, both the first layer and the second layer are formed of a monomolecular film consisting only of the compound having a functional moiety):

(1) the hydrophilic portion 32 having the functional moiety 31 of a molecule for forming a monomolecular film of the first layer 21-1 and the hydrophilic portion 32' having the functional moiety 31' of a molecule for forming a monomolecular film of the second layer 22-1 are oriented on the interface 24-1—FIG. 4(*a*);

(2) the hydrophobic portion 33 having the functional group 31 of a molecule for formation of a monomolecular film of the first layer 21-1 and the hydrophobic portion 33' having the functional moiety 31' of a molecule for formation of a monomolecular film of the second layer 22-1 are oriented on the interface 24-1—FIG. 4(*b*);

(3) The hydrophobic portion 33 having the functional moiety 31 of a molecule for forming a monomolecular film of the first layer 21-1 and the hydrophilic portion 32' having the functional moiety 31' of a molecule for forming a monomolecular film of the second layer 22-1 are oriented on the interface 24-1—FIG. 4(*c*);

(4) the hydrophilic portion 32 having the functional moiety 31 of a molecule for formation of a monomolecular film of the first layer 21-1 and the hydrophobic portion 33' having the functional moiety 31' of a molecule for formation of a monomolecular film 6-1 of the second layer are oriented on the interface 24-1—FIG. 4(*d*).

Although both of the first layer and the second layer consist of monomolecular films in the example shown in FIG. 4, of course only the first layer or only the second layer may be constituted of a monomolecular film and, in such a case, the layer not constituted of a monomolecular film may be provided as a thin film layer formed by such a thin film forming methods as the vapor deposition method, CVD method, etc.

For formation of the pattern of an interface possessed by the luminescent layer as shown in FIG. 4, compounds belonging to the type a and b compounds for formation of a monomolecular film as set forth above may preferably be employed. On the other hand, for formation of the above pattern of interface (1), it is preferred to employ the compounds belonging to the above type a for the first layer and the second layer; for formation of the above pattern of interface (2), the compounds belonging to the above type b for the first layer and the second layer; further for formation of the above pattern of interface (3), the compounds belonging to the above type a for the first layer and the compounds belonging to the above type b for the second layer; and for formation of the above pattern of interface (4), the compounds belonging to the type b for the first layer, and the compounds belonging to the type a for the second layer, respectively.

Having described an example in which the first layer and second layer are formed of a monomolecular film, it is also possible to form monomolecular films constituting the interfaces 7-1, 7-2 between the first layer and the second layer so that the interface between the first layer and the second layer may take a pattern as described above, even in the case when the first layers 5-1, 5-2 and/or the second layers 6-1, 6-2 consist of built-up monomolecular films.

When the first layers 5-1, 5-2 and/or the second layers 6-1, 6-2 consist of built-up monomolecular films, respective monomolecular films constituting the built-up films may be the same or one or more monomolecular films may be different from other monomolecular films. Further, the structure depending on the oriented state of the molecules forming the respective monomolecular films of the built-up monomolecular films may be made variously, for example, the so-called Y type (the structure in which the hydrophilic portions are faced to hydrophilic portions, or hydrophilic portions to hydrophilic portions between respective films), X type (the structure in which the hydrophobic portions are faced toward the substrate side of respective films), Z type (the structure in which the hydrophilic portions are faced toward the substrate side of respective films) and modified structures of these. Further, the monomolecular film included in the first layer and the second layer of the luminescent layer possessed by the EL device of the present invention may be a multicomponent monomolecular film formed of two or more compounds. In such a case, as explained previously about the constitution of the luminescent layer, two or more compounds having functional moieties can be combined, or alternatively a compound having a functional moiety and a compound having no functional moiety but capable of controlling electrochemical properties such as electronegativity of the luminescent layer through the interaction with the compound having the functional moiety may be combined, or further it is possible to add another component for increasing the strength of the monomolecular layer constituting the luminescent layer or improving adhesion between the respective layers.

Such a structure of a monomolecular film or built-up monomolecular film can be adequately chosen depending on the electrical characteristics of the first layer and the second layer, namely the compound or a combination of compounds forming the first layer or the second layer. For example, the potential curve of $\pi$ electrons in the direction perpendicular to the monomolecular film plane can be controlled by building up monomolecular films of a combination of the compounds belonging to the type a, b or c of the compounds for formation of monomolecular films as mentioned above.

The compounds which can be used for forming the above first layers 21-1, 21-2 and/or the second layers 22-1, 22-2 as monomolecular film or built-up monomolecular films may include the compounds capable of forming the functional moiety as previously mentioned. Of the compounds having at least one of said compounds, those having well-balanced hydrophilic portions and hydrophobic portions may be used as such for formation of monomolecular films. Otherwise, the hydrophilic groups and/or hydrophobic groups as mentioned above may be introduced newly into the molecules to form compounds suitable for formation of monomolecular films. As such compounds, the compounds represented by the structural formulae shown below may be employed.

In the structural formulae shown below, X and Y represent hydrophilic groups as mentioned above. When both of them exist in one molecule, either one of them may be hydrophilic and, in such a case, the other is hydrogen. In these formulae, R represents a straight or branched alkyl group having about 4 to 30 carbon atoms, preferably about 10 to 25 carbon atoms.

1.

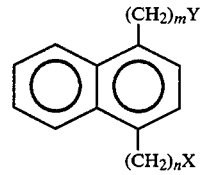

$0 \leqq m, n \leqq 25, 10 \leqq m + n$

2.

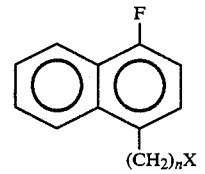

$10 \leqq n \leqq 25$

3.

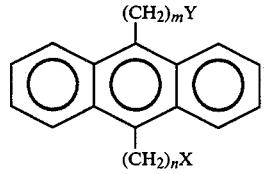

$0 \leqq m, n \leqq 20 \quad 6 \leqq m + n$

4.

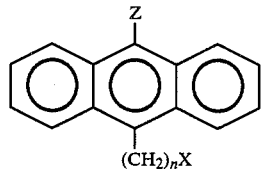

$Z = CN, F, Cl \quad 6 \leqq n \leqq 20$

5.

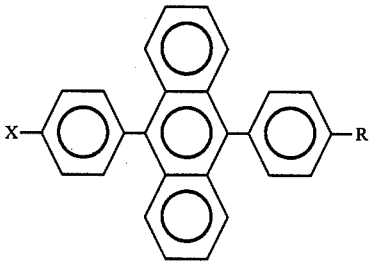

-continued

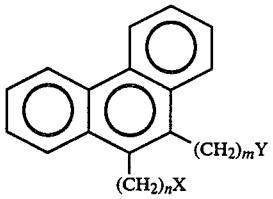

$0 \leqq m, n \leqq 20 \quad 6 \leqq m + n$

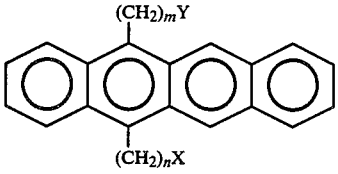

$0 \leqq m, n \leqq 20 \quad 3 \leqq m + n$

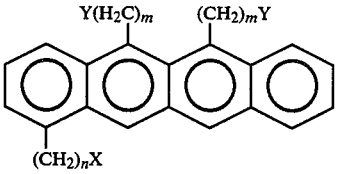

$0 \leqq m, n \leqq 20 \quad 3 \leqq m + n$

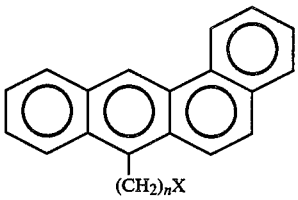

$3 \leqq n \leqq 20$

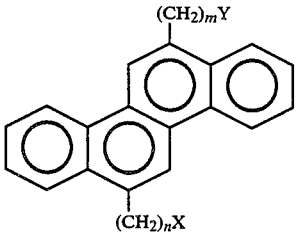

$0 \leqq m, n \leqq 20 \quad 3 \leqq m + n$

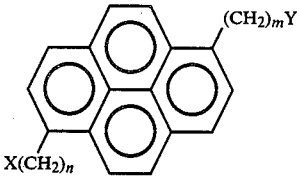

$0 \leqq m, n \leqq 20 \quad 3 \leqq m + n$

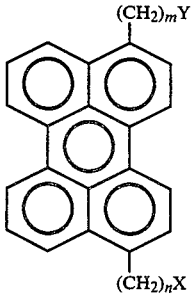

$0 \leqq m, n \leqq 20 \quad 3 \leqq m + n$

-continued

6.

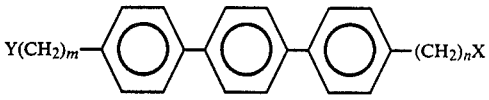

$0 \leqq m, n \leqq 20 \quad 6 \leqq m + n$

7.

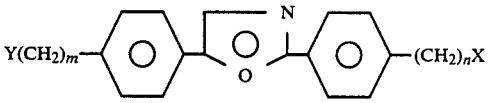

$0 \leqq m, n \leqq 20 \quad 6 \leqq m + n$

8.

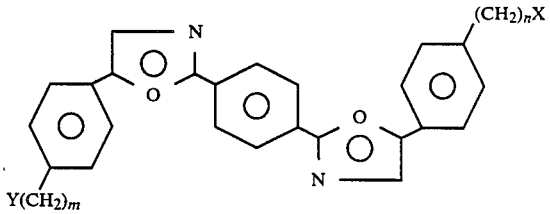

$0 \leqq m, n \leqq 20 \quad 6 \leqq m + n$

9.

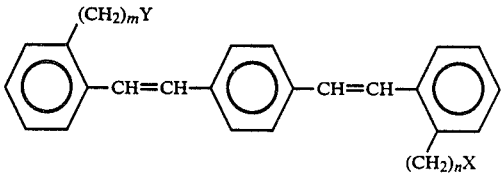

$0 \leqq m, n \leqq 20 \quad 6 \leqq m + n$

10.

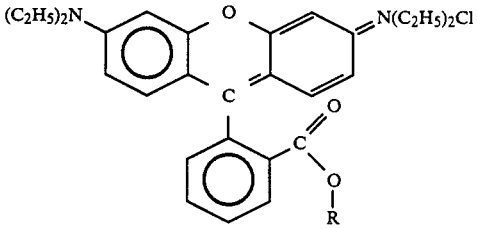

11.

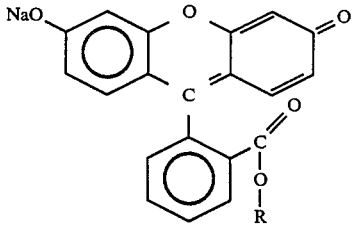

12.

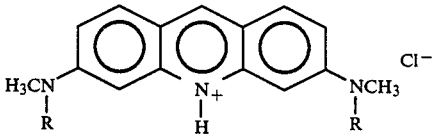

13.

$0 \leqq m, n \leqq 20 \quad 6 \leqq m + n$

14.

$0 \leqq m, n \leqq 20 \quad 6 \leqq m + n$

15.

$0 \leqq m, n \leqq 20 \quad 6 \leqq m + n$

16.

$0 \leqq m, n \leqq 20 \quad 6 \leqq m + n$

17.

18.

19.

20.

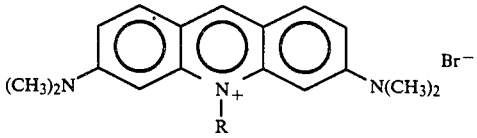

-continued
21.
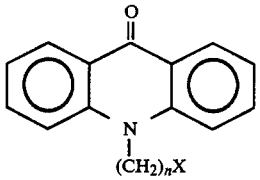
$6 \leqq n \leqq 20$
22.
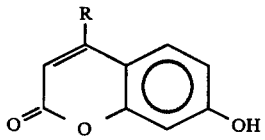
23.
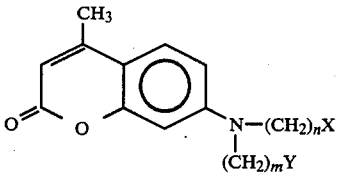
$0 \leqq m, n \leqq 20 \quad 6 \leqq m + n$
24.
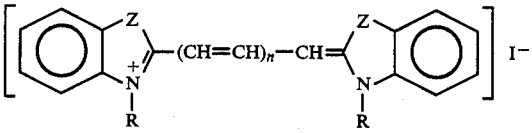
$Z = O, S, Se \quad 0 \leqq n \leqq 2$
25.
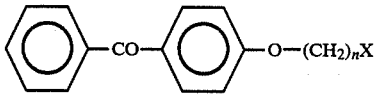
$6 \leqq n \leqq 20$
26.
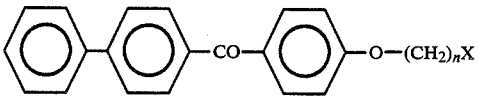
$6 \leqq n \leqq 20$
27.
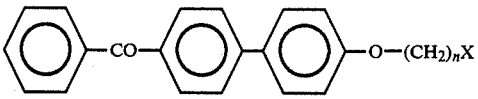
$6 \leqq n \leqq 20$
28.
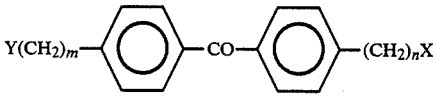
$0 \leqq m, n \leqq 20 \quad 6 \leqq m + n$
-continued
29.
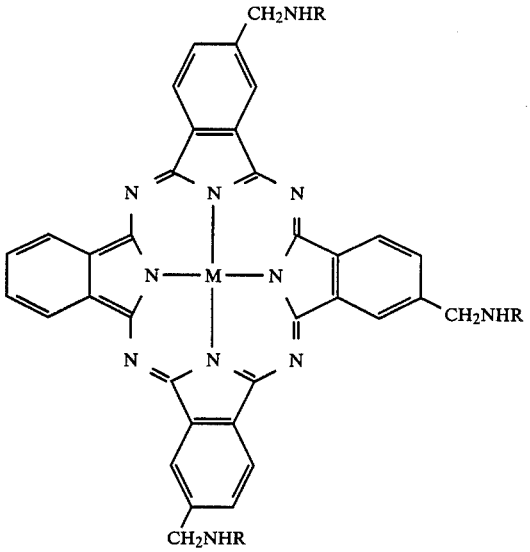
M = Mg, Zn, Sn, AlCl
30.
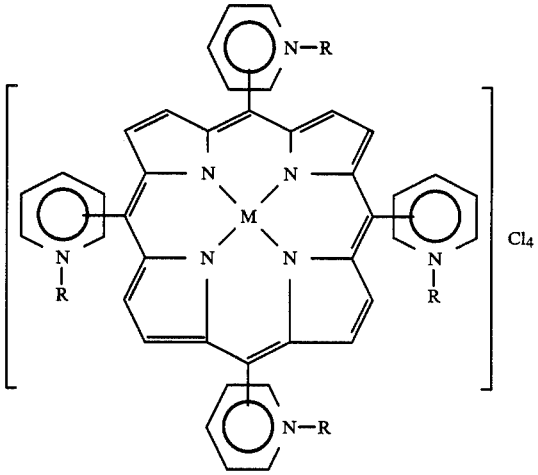
M = $H_2$, Be, Mg, Ca, Cd, Sr AlCl, YbCl
31.
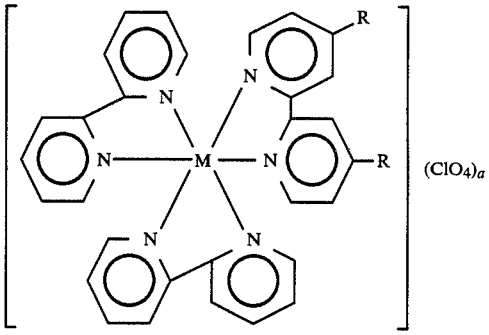
a,M = Ru, a = 2 b,M = Er, Tm, Sm, Eu, Tb, a = 3
32.
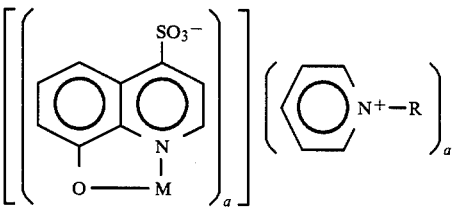

-continued
M = Al, Ga, Ir, Ta, a = 3
M = Zn, Cd, Mg, Pb, a = 2
33.
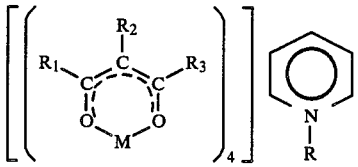
M = Er, Sm, Eu, Gd, Tb, Dy, Tm, Yb
$R_1$, $R_2$ $R_6$ = 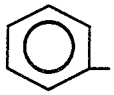 , 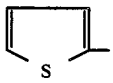 , $-CF_3$, H,
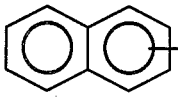 , $-CH_3$, $-t$-Bu
34.
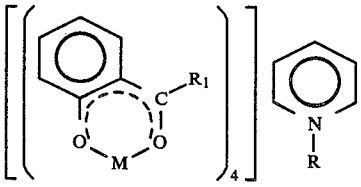
M = Er, Sm, Eu, Gd, Tb, Dy, Tm, Yb
$R_1$ = H, $-CH_3$, $-CF_3$, 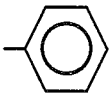
35.
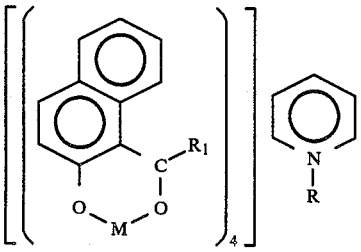
M = Er, Sm, Eu, Gd, Tb, Dy, Tm, Yb
$R_1$ = H, $-CH_3$, $-CF_3$, 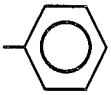
36.
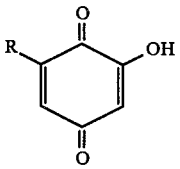
37.
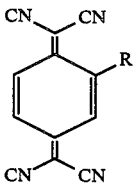
38.
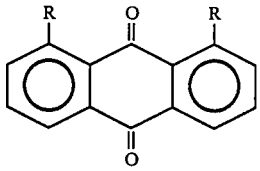
39.
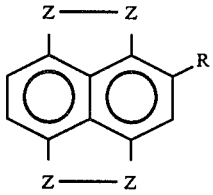
Z = S, Se
40.
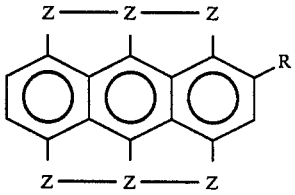
Z = S, Se
41.
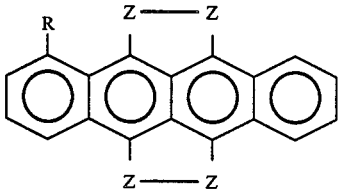
Z = S, Se
42.
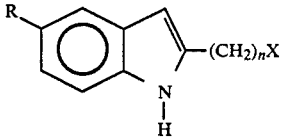
43.
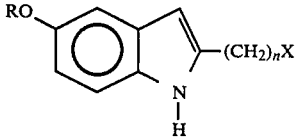
44.
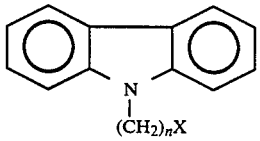
45.
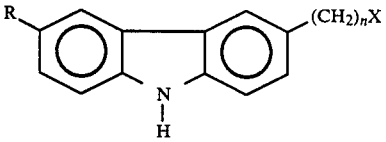
46.
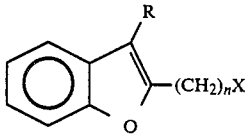

-continued
47.
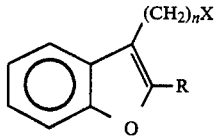
48.
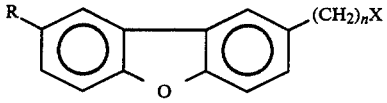
49.
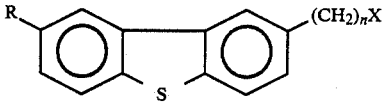
50.
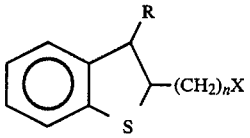
51.
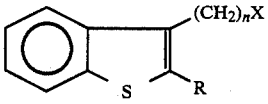
52.
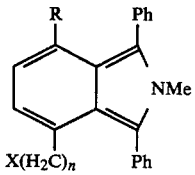
53.
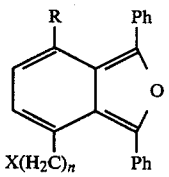
54.
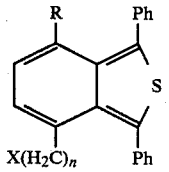
55.
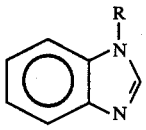
56.
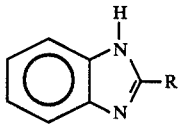
57.
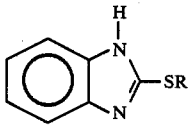
-continued
58.
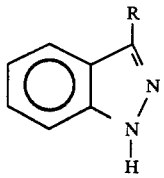
59.
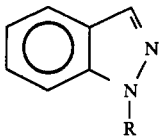
60.
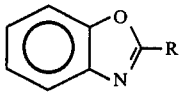
61.
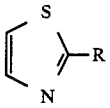
62.
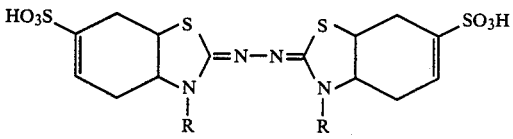
63.
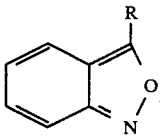
64.
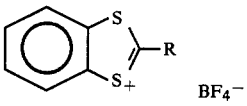
65.
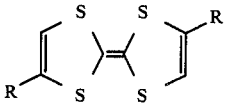
66.
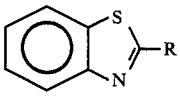
67.
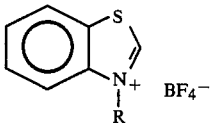
68.
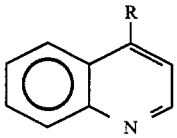

-continued
69.
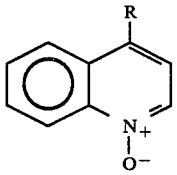
70.
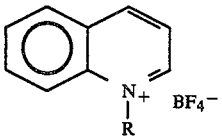
71.
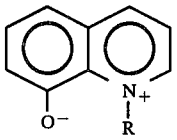
72.
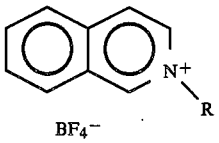
73.
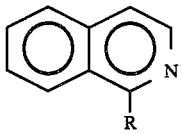
74.
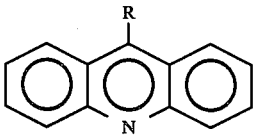
75.
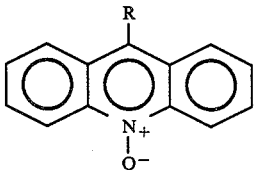
76.
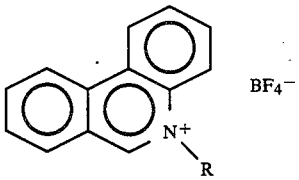
77.
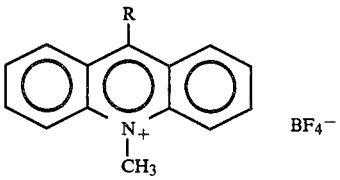
-continued
78.
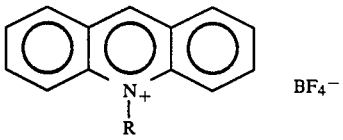
79.
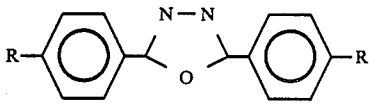
80.
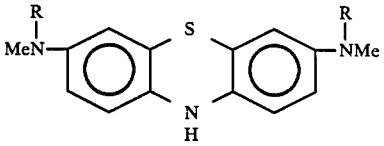
81.
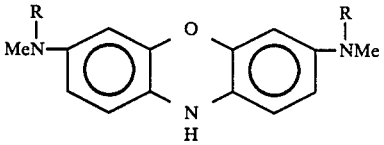
82.
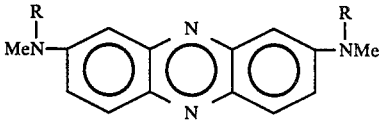
83.
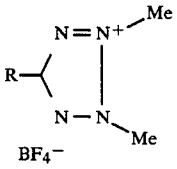
84.
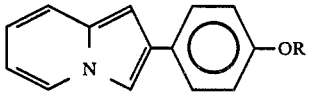
85.
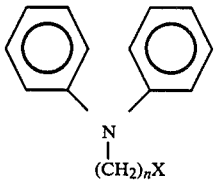
86.
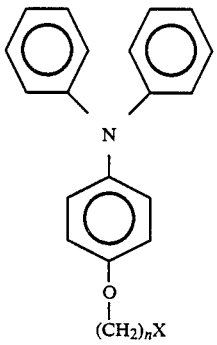

-continued

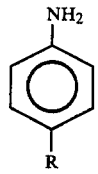

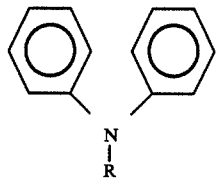

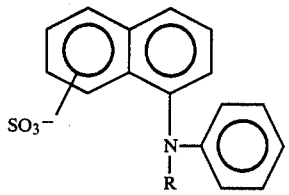

Of these compounds, the compounds of the structural formulae No. 1–No. 35 are obtained by modifying the compounds having EL function on the basis of formation of an excited complex among the compounds capable of forming functional moiety as mentioned above with hydrophobic group and/or hydrophilic group to be converted to compounds for formation of monomolecular films. The compounds of the structural formulae No. 42–No. 54 and No. 85–No. 86 have structures in which alkyl chains are directly bonded to functional moieties, and bonding to functional moieties of the alkyl chains may alternatively be bondings through, for example, ether bonding, carbonyl group.

The third layer 23-1, 23-2, 23-3, another luminescent layer possessed by the EL device of the present invention, is a layer having insulating property. Particularly, the third layer 23-1, 23-3 has the function of enhancing insulating property of the capacitor structure of the EL device of the present invention, while the third layer 23-2 has the function of confining migration of electrons within the necessary minimum region to effect luminescence through efficient giving and receiving of electrons. These third layers can also be formed according to the thin layer forming method such as the vapor deposition method, CVD method, etc. or the monomolecular built-up method. When the third layer is to be formed according to the monomolecular built-up method, it is possible to use at least one compound of the following formula capable of forming a monomolecular layer of high precision and uniform insulating property.

$$CH_3-(CH_2)_n-X,$$

or $$\begin{array}{l} CH_2OCO-(CH_2)_n-CH_3 \\ | \\ CHOCO-(CH_2)_n-CH_3 \\ | \\ CH_2OCO-(CH_2)_n-CH_3 \end{array}$$

(wherein n is $10 \leqq n \leqq 30$, X is a group such as —COOH, —$CONH_2$, —COOR, —$N^+(CH_3)_3.Cl^-$,

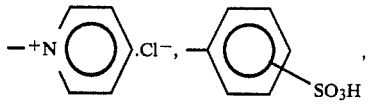

etc.)

as the material for forming the third layer.

On the other hand, when the third layer is to be formed according to the thin layer forming method such as the vapor deposition method, CVD method, etc., at least one of the above compounds or at least one of inorganic compounds such as $SiO_2$, etc. may be used as the material for forming the third layer.

When the third layer is formed as the monomolecular built-up film, the respective monomolecular films may be the same, or one or more of the respective monomolecular films may be different from other films.

Having described above the EL device of the present invention having two interfaces formed by the first layer and the second layer by referring to FIG. 2 and FIG. 3, the number of the interfaces in the luminescent layer 20 possessed by the EL device is not limited thereto, but it may have 3 or more such interfaces.

The layer thickness of each layer forming the luminescent layer 20 of the EL device of the present invention having a structure as described above, which may differ in the number of interfaces possessed by the EL device and the constitution of each layer itself, may be 500 Å or less, preferably 200 Å or less, for the first layer, 500 Å or less, preferably 200 Å or less, for the second layer, 500 Å or less, preferably 200 Å or less, for the third layer, and further 5000 Å or less, preferably 3000 Å or less for the luminescent layer as a whole, in order to obtain good luminescent state even by low voltage driving.

From the luminescent layer 20 having the structure as described above with reference to FIG. 2 and FIG. 3, two layers having the same function or different functions with respect to luminescent color or luminance may be selected so that the EL device of the present invention may have the desired EL function to provide the luminescent layer 4 and the luminescent 5, thus forming the EL device of the present invention.

Of the two electrode layers 1 and 2 possessed by the EL device of the present invention, at least one is provided as the transparent electrode for taking out light, as described above.

For formation of the electrode layer as a transparent electrode, $InO_2$, $SnO_2$, indium tin oxide (I.T.O.), etc. may be laminated according to vapor deposition, etc. on a transparent substrate such as a film or sheet of PMMA, polyester, etc. or a glass plate, or alternatively these materials may be directly laminated on the luminescent layer.

The electrode layer 3 is provided as the transparent electrode or as the translucent electrode capable of transmitting light only in one direction of the thickness direction of the electrode layer. When the electrode layer is provided as the transparent electrode, it may be formed by use of a material for formation of transparent electrode as mentioned above on the luminescent layer 4 or the luminescent layer 5 formed. When the electrode 3 is formed as the translucent electrode, it may be formed by use of a material such as Au, I.T.O. $InO_2$, $SnO_2$, etc. in view of the direction in which light is to be transmitted on the luminescent layer 4 or the luminescent layer 5.

On the other hand, an electrode layer which is not transparent may be formed by laminating directly Al, Ag, Au, etc., according to vapor deposition, etc., on a thin plate comprising a material having sufficient electroconductivity capable of forming an ordinary electrode, an appropriate substrate, or the luminescent layer formed.

These electrode layers may have a thickness of about 0.01 μm to 0.3 μm, preferably about 0.05 μm to 0.2 μm.

The shape and size of the EL device of the present invention may be formed into various shapes. For example, the substrate when forming a transparent electrode may be a substrate for formation of luminescent layer, which substrate can be shaped in plate, belt, cylinder, etc. to give any desired shape and size. Also, the electrode layers 1, 2, and 3 may be subjected to patterning in various shapes, if desired.

In the EL device of the present invention having a constitution as described above, for example, by applying direct current or alternate current or pulse voltage between the electrodes 1 and 3 and between the electrodes 2 and 3 so that an electrical field of about $1\times10^5$ to $3\times10^6$ may be applied to, for example, the respective luminescent layers 4 and 5, good luminescent can be obtained through the transparent electrode 1. Also, by use of two luminescent layers with different luminescent color or luminance for the luminescent layer 4 and the luminescent layer 5, the voltages between the electrodes 1 and 3 and between the electrodes 2 and 3 can individually be controlled to vary the color and the intensity of light from the transparent electrode 1 over wide ranges.

In the following, a typical operation of the monomolecular built-up method as represented by the Langmuir-Blogget's method (LB method) to be applied for formation of a monomolecular film or a built-up monomolecular film possessed by the luminescent layer of the EL device of the present invention is described.

An aqueous phase for formation of a monomolecular film is provided in a water tank, and a clean substrate is dipped in said aqeuous phase. Then, a prescribed amount of a solution or dispersion of a compound for formation of a monomolecular film in an appropriate solvent is spread into the aqueous phase to have this compound formed in a film on the aqueous phase surface. During this operation, in order that the compound may not be diffused freely to be expanded excessively, a partition plate (or buoy) is provided to restrict the spreading area, thereby restricting the gathered state of the film material, to obtain a surface pressure II in proportion to its gathered state. And, by actuating the partition plate to reduce the spreading area, the surface pressure II is gradually elevated to set a surface pressure II suitable for formation of a monomolecular film. Here, the substrate already dipped can be moved up and down quietly in the direction perpendicular to the aqueous phase while maintaining the surface pressure II, whereby the monomolecular film can be transferred for each of the upward movement and the downward movement to form a built-up monomolecular film.

For transfer of the monomolecular film onto a substrate, in addition to the above vertical dipping method, it is also possible to employ the horizontal attachment method, in which the substrate is permitted to contact the water surface while maintaining it in parallel to the aqueous phase, the rotatory cylinder method in which a cylindrical substrate is rotated on the water surface to have the monomolecular film transferred onto the substrate surface, or the method in which a substrate is extruded from a substrate roll into the aqueous phase. According to the above vertical dipping method, since orientations of the molecules in the film formed become opposite in the withdrawing step and the dipping step, the so called Y type film is formed. On the other hand, according to the horizontal attachment method, a monomolecular film with hydrophobic groups facing toward the substrate side is formed, and the so called X-type film is formed in case of a built-up film. However, the directions of such hydrophilic groups or hydrophobic groups can also be changed by surface treatment of the substrate, etc.

Further, the operational conditions during formation of a monomolecular film according to the monomolecular built-up method, such as pH of the aqueous phase, the kinds of the additives for controlling pH, etc. of the aqueous phase and their amounts, the temperature of the aqueous phase, the speed of moving up and down the substrate, or surface pressure, may adequately be selected depending on the type of compound for formation of monomolecular film employed, the characteristics of the film to be formed, etc.

The EL device of the present invention may be formed as described below by the above-mentioned monomolecular built-up method and other thin layer formation methods such as vapor deposition, etc.

First, on the substrate having a transparent electrode layer provided thereon as described above, a third layer is formed having a desired constitution which is formed with the use of a material for formation of the third layer, and further a first layer and a second layer with desired constitutions formed with the use of materials capable of forming the first layer and the second layer as described above are laminated successively in this order on the third layer previously formed. Then, on the second layer is laminated the third layer, and the operations for formation of the first layer to the third layer are repeated twice or more depending on the desired number of interfaces between the first layer and the second layer to form a luminescent layer 4.

After the luminescent layer 4 is thus formed, a metal such as Au, etc. is laminated on the third layer positioned at the top of the luminescent layer 4 according to vapor deposition, etc. to form a translucent electrode 3.

Further on the electrode layer 3, similarly to the formation of the luminescent layer 4, a luminescent layer 5 is formed with the use of a material which is the same as or different from the luminescent layer 4, followed finally by lamination of a metal such as Al, Ag, Au, etc. on the third layer possessed by the luminescent layer 5, to form the EL device of the present invention.

When both of the two electrodes are transparent, a transparent electrode layer may be formed with the above material on the transparent substrate for formation of the luminescent layers 4 and 5 and a transparent electrode layer may be laminated after formation of the luminescent layer 5 has been completed.

In the case of forming an EL device of the present invention as described above, the respective layers of the first layer, the second layer and the third layer possessed by the luminescent layer 4 and the luminescent layer 5 may be formed with the materials for formation of these layers according to the thin layer forming methods suitable for these materials, and at least one layer of the first layer, the second layer and the third layer possessed by one or both of the luminescent layer 4 and the luminescent layer 5 is formed of a monomolecular film or a built-up monomolecular film. In order to form the entire layer thickness of the luminescent layer as thin as possible in order to obtain a high luminance even by low voltage driving, the number of the layers of monomolecular film or built-up monomolecular films should preferably be as many as possible among the respective layers for forming the luminescent layer. Further, in order to obtain luminescence based on formation of an excited complex accompanied with giving and receiving of electrons with better efficiency by orientation and arrangement of the functional portion of the compound participating directly in luminescence toward the surface effecting luminescence possessed by the luminescent layer 4 and the luminescent layer 5 with higher degree of order and good precision, it is preferred to form at least one of the first layer and the second layer for forming the interface effecting primarily luminescence possessed by the luminescent layer 4 and the luminescent layer 5 as a monomolecular film or built-up monomolecular films. Further, more preferably, both the first layer and the second layer should be formed of a monomolecular film or built-up monomolecular films. However, this is not imperative when the respective layers are to be formed with the use of material compounds which cannot be formed as monomolecular films.

Also, the plural number of the first layers possessed by the luminescent layer in the EL device of the present invention may have the same constitution, or alternatively one or more of the plural number of the first layers may have a constitution different from that of other first layers. This is also the case with respect to the second layers and the third layers. Between the respective layers constituting the El device of the present invention, adhesive layers can be provided for enhancement of adhesion between the respective layers. Further, the EL device of the present invention should desirably be provided with a protective structure for protection of the device against influences from humiditiy and oxygen in the air.

The EL device of the present invention as described above has two luminescent layers, each of which can independently be controlled, and it has been rendered possible to change the luminescent color, control severely the tone and control freely the intensity of luminescence by controlling individually these luminescent layers.

Further, the luminescent layers possessed by the EL device of the present invention effect luminescent primarily at the interfaces between the two layers different in electrochemical properties, and yet such interfaces have a structure to be provided in a plural number in the direction for taking out light in the EL device, whereby the quantity of luminescence per unit of the plane for taking out light has been extremely increased as compared with the EL device of the prior art.

Also, in the EL device of the present invention, the plural number of interfaces for effecting primarily luminescence may be varied in the constitutions of the two layers constituting said interface, and the luminescent color, etc. can be controlled as desired by suitable combinations of these variations.

In addition to these, the luminescent layers possessed by the EL device of the present invention can be formed primarily of an organic compound material in combination with thin film formation suitable for that material. Therefore, in spite of a multi-layer structure having a plural number of interfaces for effecting luminescence, the luminescent layer as a whole is formed to have a thinner layer thickness, thus enabling efficient luminescence even by low voltage driving to give sufficient luminance.

Particularly, in the luminescent layer having a monomolecular film, the layer thickness of the whole luminescent layer can be formed thinner by forming at least one of the respective layers constituting the luminescent layer of a monomolecular film or built-up monomolecular films. Also, when the luminescent layer is formed of built-up monomolecular films, the layer thickness of the luminescent layer can be made extremely thin to further enhance the above effect.

Besides, in the luminescent layer possessed by the EL device of the present invention, when the first layer and/or the second layer is formed of a monomolecular film or built-up monomolecular films, the functional moieties of the compound participating directly in luminescence can be oriented and arranged to face toward the interface of the first layer and the second layer with high order and good precision, whereby luminescence based on formation of an excited complex accompanied with giving and receiving of electrons can be effected with good efficiency.

Further, the respective layers of the luminescent layer in the EL device of the present invention can be formed easily as thin films with good precision primarily from various organic compound materials. Particularly, the first layer, the second layer or the third layer, when formed as a monomolecular film or built-up monomolecular films, can be formed under approximately normal temperature and normal pressure, and therefore even material compounds of weak heat resistance not available in the vapor deposition method, etc. can also be used for formation of these layers, whereby the EL device of the present invention can be an EL device which is cheap and capable of bulk production.

In addition, since the respective layers of the luminescent layer in the EL device of the present invention can be formed easily as thin films with good precision primarily from various organic compound materials, EL devices with large area can be formed to have luminescent layers formed with good precision. Thus, the EL device of the present invention can have good functions also as an EL device with large area.

The present invention is described in more detail by referring to the following Reference examples and Examples.

Reference example 1

[Formation of luminescent layers No. 1 and No. 2]

On a 50 mm square glass surface, an I.T.O. layer with a thickness of 1500 Å was formed according to the sputtering method, and this was used as the substrate for formation of luminescent layer. The substrate was dipped in an aqueous phase controlled to pH 6.5 by containing $4\times10^{-4}$ mol/liter of $CdCl_2$ in Langumiur-Trough 4 (tradename, produced by Joyce-Loebel Co. Ltd.).

Next, 0.5 ml of a solution of arachidic acid in chloroform at a concentration of $1\times10^{-3}$ mol/liter was spread over the above aqueous phase. After evaporation of chloroform from the aqueous phase surface, the aqueous phase surface pressure was adjusted to 30 dyne/cm, and a film of arachidic acid was formed on the aqueous phase surface.

Further, while maintaining constantly the surface pressure, the substrate was pulled up quietly at a speed of 2 cm/min. in the direction across the water surface, and an insulating layer comprising a monomolecular film of arachidic acid molecules as the third layer was formed on the electrode layer, and this was pulled out of the aqueous phase and allowed to stand at room temperature for 30 minutes or longer for drying.

Here, the arachidic acid remaining on the aqueous phase surface was completely removed from said aqueous phase surface, and the substrate having a monomolecular insulating layer comprising arachidic acid formed thereon was dipped again into the aqueous phase. Then, 0.5 ml of a chloroform solution containing the following compound:

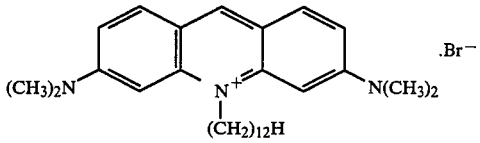

at a concentration of $1\times10^{-3}$ mol/liter was freshly spread over the aqueous phase and adjusted to a surface pressure of 30 dyne/cm, whereupon the substrate was pulled up quietly at a speed of 2 cm/min. in the direction across the water surface to have a monomolecular film comprising the molecules of the above compound formed as the second layer on the insulating layer. Subsequently, the substrate was pulled out of the aqueous phase and allowed to stand at room temperature again for 30 minutes or longer for drying.

Further, the above compound remaining on the aqueous phase surface was completely removed and the substrate dipped again into the aqueous phase and 0.5 ml of a chloroform solution containing the following compound:

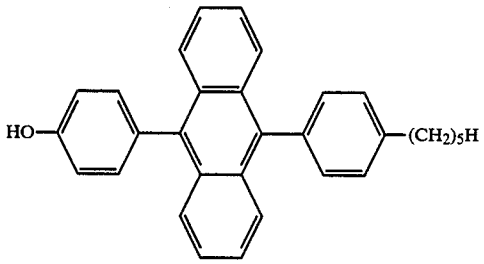

at a concentration of $1\times10^{-3}$ mol/liter was freshly spread over the aqueous phase and adjusted to a surface pressure of 30 dyne/cm, whereupon the substrate was pulled up quietly at a speed of 2 cm/min. in the direction across the water surface to have a monomolecular film comprising the molecules of the above compound formed as the first layer on the second layer.

In the following steps, the formation operations of from the third layer to the second layer as described above were repeated 16 times, followed finally by lamination of the third layer to form a luminescent layer No. 1 (layer thickness: about 1600 Å) having 16 interfaces between the first layers and the second layers.

Further, the above procedure was repeated except that the formation operations of from the third layer to the second layer were repeated 12 times to form a luminescent layer No. 2 (layer thickness: about 1200 Å) having 12 interfaces between the first layers and the second layers.

Reference example 2

[Formation of the luminescent layer No. 3]

The same substrate as used in Reference example 1 was dipped in the same aqueous phase for formation of monomolecular film as used in Reference example 1.

Next, 0.5 ml of a solution of arachidic acid in chloroform at a concentration of $1\times10^{-3}$ mol/liter was spread over the above aqueous phase. After evaporation of chloroform from the aqueous phase surface, the aqueous phase surface pressure was adjusted to 30 dyne/cm, and a film or arachidic acid was formed on the aqueous phase surface.

Further, while maintaining constantly the surface pressure, the substrate was moved quietly up and down at a speed of 2 cm/min. in the direction across the water surface twice, and the third layer as an insulating layer comprising four monomolecular layers of arachidic acid molecules was formed on the electrode layer on the substrate, and this was drawn out of the aqueous phase and allowed to stand at room temperature for 30 minutes or longer for drying.

Here, the arachidic acid remaining on the aqueous phase surface was completely removed from said aqueous phase surface, and the substrate having a monomolecular insulating layer comprising arachidic acid formed thereon was dipped again into the aqueous phase. Then, 0.5 ml of a chloroform solution containing the following compound:

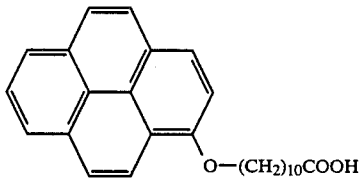

at a concentration of $1\times10^{-3}$ mol/liter was freshly spread over the aqueous phase and adjusted to a surface pressure of 30 dyne/cm, whereupon the substrate was pulled up quietly at a speed of 2 cm/min. in the direction across the water surface, followed further by dipping and pulling up, to have a monomolecular film comprising three monomolecular layers of the above compound formed as the first layer on the insulating layer. Subsequently, the substrate was pulled out of the aqueous phase and allowed to stand at room temperature again for 30 minutes or longer for drying.

Then, the above compound remaining on the aqueous phase surface was completely removed and the substrate dipped again into the aqueous phase and 0.5 ml of a chloroform solution containing the following compound:

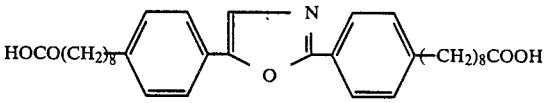

at a concentration of $1\times10^{-3}$ mol/liter was freshly spread over the aqueous phase and adjusted to a surface pressure of 30 dyne/cm, whereupon the substrate was pulled up quietly at a speed of 2 cm/min. in the direction across the water surface, followed further by dipping and pulling up, to have a monomolecular film comprising three monomolecular layers of the above compound formed as the second on the first layer previously formed.

In the following steps, the formation operations of from the third layer to the second layer as described above were repeated 4 times, followed finally by lamination of the third layer to form a luminescent layer No. 3 (layer thickness: about 1100 Å) having 4 interfaces between the first layers and the second layers.

Reference example 3

[Formation of the luminescent layer No. 4]

The same substrate as used in Reference example 1 was dipped in the same aqueous phase for formation of monomolecular film as used in Reference example 1.

Next, 0.5 ml of a solution of arachidic acid in chloroform at a concentration of $1\times10^{-3}$ mol/liter was spread over the above aqueous phase. After evaporation of chloroform from the aqueous phase surface, the aqueous phase surface pressure was adjusted to 30 dyne/cm, and a film of arachidic acid was formed on the aqueous phase surface.

Further, while maintaining constantly the surface pressure, the substrate was pulled up quietly at a speed of 2 cm/min. in the direction across the water surface, and a monomolecular film comprising arachidic acid molecules was formed in the electrode layer on the substrate, and this was pulled out of the aqueous phase and allowed to stand at room temperature for 30 minutes or longer for drying. This operation was repeated once more to form an insulating layer having two monomolecular layers of arachidic acid as the third layer.

Here, the arachidic acid remaining on the aqueous phase surface was completely removed from said aqueous phase surface, and 0.5 ml of a chloroform solution containing the following compounds:

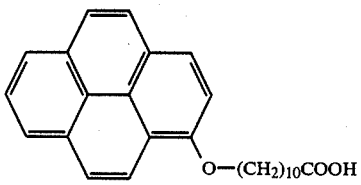

and

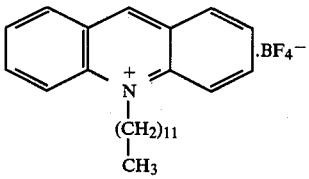

at a ratio of 100 mol:1 mol and at a total concentration of $1\times10^{-3}$ mol/liter was freshly spread over the aqueous phase and adjusted to a surface tension of 30 dyne/cm, whereupon the substrate was dipped quietly again into the aqueous phase at a speed of 2 cm/min. in the direction across the water surface to have a monomolecular film comprising the molecules of the above two kinds of compounds formed as the first layer on the insulating layer. Subsequently, the substrate was pulled out of the aqueous phase and allowed to stand at room temperature again for 30 minutes or longer for drying.

Further, the above compounds remaining on the aqueous phase surface were completely removed and 0.5 ml of a chloroform solution containing the following compounds:

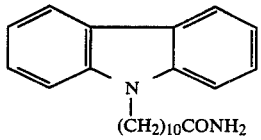

and

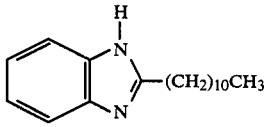

at a ratio of 100 mol:1 mol and at a total concentration of $1\times10^{-3}$ mol/liter was freshy spread over the aqueous phase and adjusted to a surface pressure of 30 dyne/cm, whereupon the above operation for forming the first layer was repeated to form a monomolecular film comprising the molecules of the above two kinds of compounds as the second layer on the first layer previously formed.

In the following steps, the formation operations from the third layer to the second layer as described above were repeated 15 times, followed finally by lamination of the third layer to form a luminescent layer No. 4 (layer thickness: about 1500 Å) having 15 interfaces between the first layers and the second layers.

Reference example 4

[Formation of the luminescent layer No. 5]

The same substrate as used in Reference example 1 was dipped in the same aqueous phase for formation of monomolecular film as used in Reference example 1.

Next, the operation for forming the monomolecular layer comprising arachidic acid in Reference example 3 was repeated 5 times to form an insulating layer comprising five monomolecular layers of arachidic acid as the third layer.

Here, the arachidic acid remaining on the aqueous phase surface was completely removed from said aqueous phase surface, and 0.5 ml of a chloroform solution containing the following compounds:

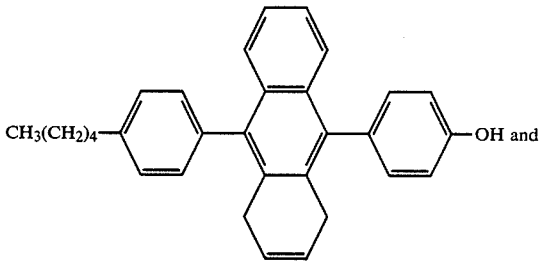

and

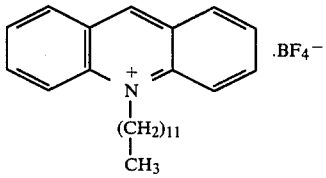

at a ratio of 100 mol:1 mol and at a total concentration of $1\times10^{-3}$ mol/liter was freshly spread over the aqueous phase and adjusted to a surface pressure of 30 dyne/cm, whereupon the substrate was dipped quietly again into the aqueous phase at a speed of 2 cm/min. in the direction across the water surface, followed further by moving up and down, to have three built-up layers of a monomolecular film comprising the molecules of the above two kinds of compounds formed as the first layer on the insulating layer previously formed. Subsequently, the substrate was pulled out of the aqueous phase and allowed to stand at room temperature again for 30 minutes or longer for drying.

Further, the above compounds remaining on the aqueous phase surface were completely removed and and 0.5 ml of a chloroform solution containing the following compounds:

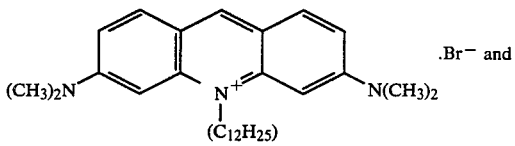

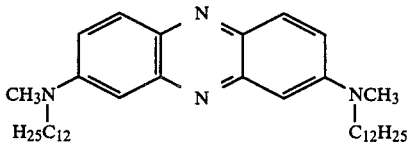

at a ratio of 10 mol:1 mol and at a total concentration of $1\times10^{-3}$ mol/liter was freshly spread over the aqueous phase and adjusted to a surface pressure of 30 dyne/cm, whereupon the above operation for forming the first layer was repeated to form three built-up layers of a monomolecular film comprising the molecules of the above two kinds of compounds as the second layer on the first layer previously formed.

In the following steps, the operation for formation of a monomolecular film comprising arachidic acid in Reference example 3 was repeated four times to form an insulating film comprising four monomolecular layers of arachidic acid as the third layer on the second layer previously formed, and thereafter the formation operations from the first layer to the third layer (a monomolecular built-up film comprising four monomolecular layers of arachidic acid) as described above were repeated 4 times to form a luminescent layer No. 5 (layer thickness: about 1100 Å) having 4 interfaces between the first layers and the second layers.

Reference example 5

[Formation of the luminescent layer No. 6]

The same substrate as used in Reference example 1 was dipped in the same aqueous phase for formation of monomolecular film as used in Reference example 1, and the operation for forming the monomolecular layer comprising arachidic acid in Reference example 3 was repeated twice, and thereby an insulating layer comprising two monomolecular layers of arachidic acid as the third layer was formed in the electrode layer of the above substrate.

Here, the arachidic acid remaining on the aqueous phase surface was completely removed from said aqueous phase surface, and 0.5 ml of a chloroform solution containing the following compounds:

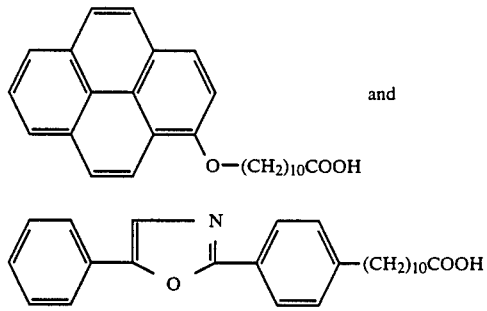

at a ratio of 10 mol:1 mol and at a total concentration of $1\times10^{-3}$ mol/liter was freshly spread over the aqueous phase and adjusted to a surface pressure of 30 dyne/cm, whereupon the substrate was dipped quietly again into the aqueous phase at a speed of 2 cm/min. in the direction across the water surface, to have a monomolecular film comprising the molecules of the above two kinds of compounds formed as the first layer on the insulating layer previously formed. Subsequently, the substrate was pulled out of the aqueous phase and allowed to stand at room temperature again for 30 minutes or longer for drying.

Further, the above compounds remaining on the aqueous phase surface were completely removed and 0.5 ml of a chloroform solution containing the following compounds:

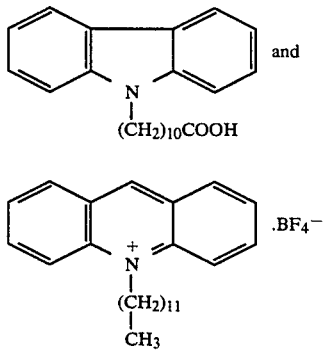

at a ratio of 10 mol:1 mol and at a total concentration of $1\times10^{-3}$ mol/liter was freshly spread over the aqueous phase and adjusted to a surface pressure of 30 dyne/cm, whereupon the above operation for forming the first layer was repeated to form a monomolecular film comprising the molecules of the above two kinds of compounds as the second layer on the first layer previously formed.

In the following steps, the operation for formation of from the third layer to the second layer as above was repeated 15 times, followed finally by lamination of the third layer, to form a luminescent layer No. 6 (layer thickness: about 1500 Å) having 15 interfaces between the first layers and the second layers.

Reference example 6

[Formation of the luminescent layer No. 7

The same substrate as used in Reference example 1 was dipped in the same aqueous phase for formation of monomolecular film as used in Reference example 1.

Next, the operation for forming the monomolecular layer comprising arachidic acid in Reference example 3 was repeated 5 times to form an insulating layer comprising five monomolecular layers of arachidic acid as the third layer.

Here, the arachidic acid remaining on the aqueous phase surface was completely removed from said aqueous phase surface, and 0.5 ml of a chloroform solution containing the following compounds:

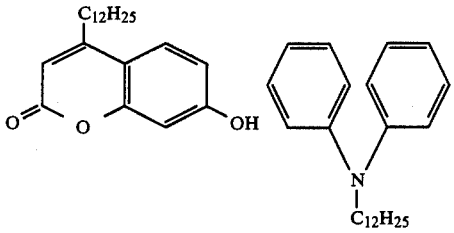

at ratio of 10 mol:1 mol and at a total concentration of $1\times10^{-3}$ mol/liter was freshly spread over the aqueous phase and adjusted to a surface pressure of 30 dyne/cm, whereupon the substrate was dipped quietly again into the aqueous phase at a speed of 2 cm/min. in the direction across the water surface, followed further by moving up and down, to have three built-up layers of a monomolecular film comprising the molecules of the above two kinds of compounds formed as the first layer on the insulating layer previously formed. Subsequently, the substrate was pulled out of the aqueous phase and allowed to stand at room temperature again for 30 minutes or longer for drying.

Further, an aqueous phase saturated with $[Eu(BFA)_4]K$ was newly prepared besides the aqueous phase used in the above operations, and on the surface of this aqueous phase, 0.5 ml of a chloroform solution containing the following compounds:

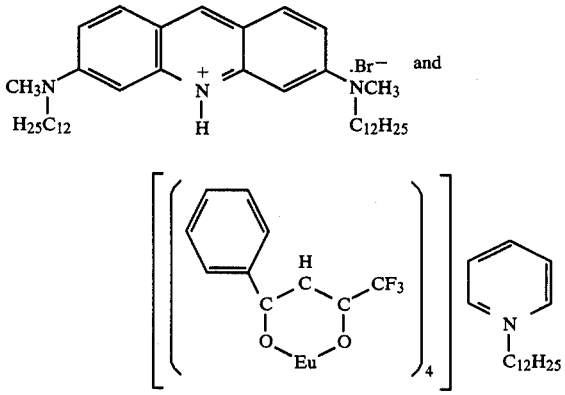

at a ratio of 10 mol:1 mol and at a total concentration of $1\times10^{-3}$ mol/liter was freshly spread over the aqueous phase and adjusted to a surface pressure of 30 dyne/cm, whereupon the above operation for forming the first layer was repeated to form three built-up layers of a monomolecular film comprising the molecules of the above two kinds of compounds as the second layer on the first layer previously formed.

In the following steps, the operation for formation of a monomolecular film comprising arachidic acid in Reference example 3 was repeated four times to form an insulating film comprising four monomolecular layers of arachidic acid as the third layer on the second layer previously formed, and thereafter the formation operations of from the first layer to the third layer (a monomolecular built-up film comprising four monomolecular layers of arachidic acid) as described above were repeated 4 times to form a luminescent layer No. 7 (layer thickness: about 1100 Å) having 4 interfaces between the first layers and the second layers.

Reference example 7

[Formation of the luminescent layer 8]

The same substrate as used in Reference example 1 was set at a predetermined position in a vapor deposition chamber in a resistance heating vapor deposition device, further methyl stearate (m.p. 38° C.) was charged into the resistance heating boat. After the chamber was first internally evacuated to vacuum pressure of $10^{-6}$ Torr, the current flowing through the boat was controlled so that the vapor deposition speed was 2 Å/sec, and a vapor deposited layer comprising a methyl stearate layer of 200 Å thick was formed as the third layer on the transparent electrode of the above substrate. During vapor deposition, the vacuum pressure in the chamber was maintained at $9\times10^{-6}$ Torr and the temperature of the substrate holder at 20° C.

Further, the substrate was dipped in the same aqueous phase for formation of a monomolecular film as used in Reference example 1.

Next, 0.5 ml of a chloroform solution containing the compounds:

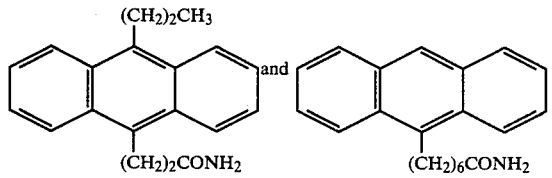

at a proportion of 1 mol:1 mol and a total concentration of $1\times10^{-3}$ mol/liter was spread over the above aqueous phase, and the surface pressure was controlled to 30 dyne/cm to form a multi-component system monomolecular film comprising the above two compounds, whereupon the substrate was moved quitely up and down at a speed of 2 cm/min. in the direction across the water face twice, to form four built-up layers of a monomolecular film comprising the mixture of the above compounds as the first layer on the third layer previously formed. Here, the substrate was pulled out of the aqueous phase and allowed to stand at room temperature for 30 minutes or longer for drying.

Further, the above compounds remaining on the aqueous phase were completely removed, the substrate was dipped again into the aqueous phase, and 0.5 ml of a chloroform solution containing the compound:

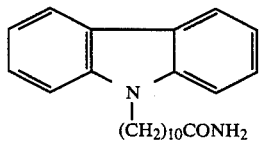

at a concentration of $1\times10^{-3}$ mol/l was freshly spread over the aqueous phase, and the surface pressure was controlled to 30 dyne/cm to form a monomolecular film comprising this compound over said aqueous phase, and the substrate was pulled quietly at a speed of 2 cm/min. in the direction across the water surface, followed further by dipping and pulling up, to have three built-up layers of a monomolecular film comprising the above compound molecules formed as the second layer on the first layer previously formed.

In the following steps, the forming operations of from the third layer to the second layer as described were repeated four times, followed finally by lamination of the third layer, to form a luminescent layer No. 8 (layer thickness: about 1800 Å).

Reference 8

[Formation of the luminescent layer No. 9]

The same substrate as used in Reference example 1 was dipped in the same aqueous phase for formation of a monomolecular film as used in Reference example 1.

Next, 0.5 ml of a solution of stearic acid dissolved in chloroform solution of a concentration of $1\times10^{-3}$ mol/liter was spread over the above aqueous phase. After evaporation of chloroform from the aqueous phase surface, the surface pressure of the aqueous phase was controlled to 30 dyne/cm to form a film of stearic acid on the aqueous phase surface.

Further, while maintaining constantly the surface pressure, the substrate was pulled up quietly at a speed of 2 cm/min. in the direction across the water surface to form a monomolecular film comprising stearic acid molecules in the third layer on the above electrode layer of the substrate, and the substrate was pulled out of the squeous phase and allowed to stand at room temperature for 30 minutes or longer for drying. Further, this operation was repeated twice to form a monomolecular built-up film having the three monomolecular layers comprising stearic acid molecules as the third layer on the electrode layer on the above substrate. Stearic acid remaining on the aqueous phase was completely removed from the aqueous phase.

Next, this substrate was set at a predetermined position in a vapor deposition chamber in a resistance heating vapor deposition device, further anthracene (m.p. 216° C.) was charged into the resistance heating boat. After the chamber was first internally evacuated to vacuum pressure of $10^{-6}$ Torr, the current flowing through the boat was controlled so that the vapor deposition speed was 2 Å/sec, and a vapor deposited layer comprising an anthracene layer of 200 Å thick was formed as the first layer on the insulating layer as the third layer previously formed. During vapor deposition, the vacuum pressure in the chamber was maintained at $9\times10^{-6}$ Torr and the temperature of the substrate holder at 20° C.

After the first layer was thus formed, the electrode substrate was again dipped into the aqueous phase used for formation of the third layer from which remaining stearic acid had completely been removed, and then 0.5 ml of a chloroform solution containing the compound:

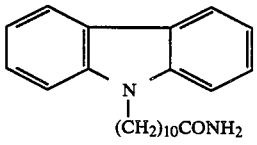

at a concentration of $1\times10^{-3}$ mol/liter was spread over the aqueous phase and the surface pressure was controlled to 30 dyne/cm to form a monomolecular film of the above compound on the aqueous surface, whereupon the substrate was pulled up at a speed of 2 cm/min. in the direction across the water surface, followed further by dipping and pulling up, to have a monomolecular built-up film comprising three monomolecular layers of the above compound molecules formed as the second layer on the first layer previously formed. Then, the substrate was pulled out of the aqueous phase, and allowed to stand at room temperature for 30 minutes or longer for drying.

In the following steps, on the second layer thus formed, the operation for forming a monomolecular film comprising stearic acid as described above was repeated twice to form the third layer comprising two built-up layers of the monomolecular film of stearic acid, and the operations for forming the first layer to the third layer were repeated four times to form a luminescent layer No. 9 (layer thickness: about 1500 Å) having four interfaces between the first layers and the second layers.

Reference example 9

[Formation of the luminescent layer No. 10]

The same substrate was used in Reference example 1 was dipped in the same aqueous phase for formation of a monomolecular film as used in Reference example 1.

Next, the operation for forming a monomolecular film comprising stearic acid in Reference example 8 was repeated three times to form a monomolecular built-up film having three monomolecular layers of stearic acid as the third layer on the electrode layer of the above substrate. Stearic acid remaining on the aqueous phase surface was completely removed from said aqueous phase surface.

Subsequently, the substrate having the third layer thus formed thereon was dipped again into the aqueous phase from which remaining stearic acid had completely been removed, 0.5 ml of a chloroform solution containing the compounds:

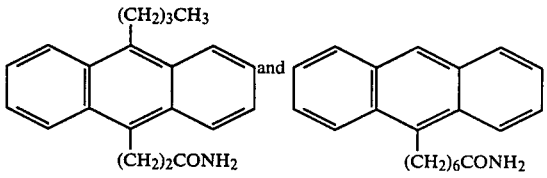

at a proportion of 1 mol:1 mol and at a total concentration of $1\times10^{-3}$ mol/liter was freshly spread over the aqueous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film having 4 built-up layers of the monomolecular film comprising molecules of the above compounds as the first layer on the third layer previously formed. The, the substrate was pulled out of the aqueous phase and allowed to stand at room temperature for 30 minutes or longer for drying.

Next, this substrate was set at a predetermined position in a vapor deposition chamber in a resistance heating vapor deposition device, further 2,5-diphenyloxazole was charged into the resistance heating boat. After the chamber was first internally evacuated to vacuum pressure of $10^{-6}$ Torr, the current flowing through the boat was controlled so that the vapor deposition speed was 2 Å/sec, and a vapor deposited layer comprising a 2,5-diphenyloxazole layer of 200 Å thick was formed as the second layer on the first layer previously formed. During vapor deposition, the vacuum pressure in the chamber was maintained at $9\times10^{-6}$ Torr and the temperature of the substrate holder at 20° C.

In the following steps, on the second layer thus formed, the operation for forming a monomolecular film comprising stearic acid as described above was repeated twice to form the third layer comprising two built-up layers of the monomolecular film comprising stearic acid, and the operations for forming the first layer to the third layer were repeated four times to form a luminescent layer No. 10 (layer thickness: about 2200 Å) having four interfaces between the first layers and the second layers.

Reference example 10

[Formation of the luminescent layer No. 11]

On the same substrate as used in Reference example 1, a vapor deposited layer comprising the methyl stearate layer of 200 Å thick as formed in Reference example 7 was formed as the third layer according to the same method as in Reference example 7.

The substrate having the third layer formed thereon was dipped in the same aqueous phase for formation of a monomolecular film as employed in Reference example 1.

Next, 0.5 ml of a chloroform solution containing the compounds:

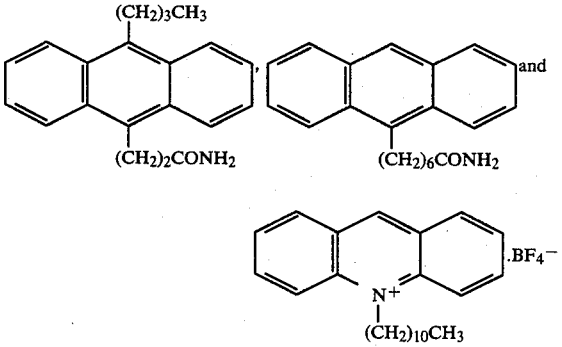

at a proportion of 50 mol:50 mol:1 mol and at a total concentration of $1\times10^{-3}$ mol/liter was spread over the aqueous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film comprising four monomolecular layers of molecules of the above compounds as the first layer on the third layer previously formed. Then, the substrate was pulled out of the aqueous phase and allowed to stand at room temperature for 30 minutes or longer for drying.

Further, the above compounds remaining on the aqueous phase were completely removed, the substrate was dipped into the aqueous phase, and 0.5 ml of a chloroform solution containing the compounds:

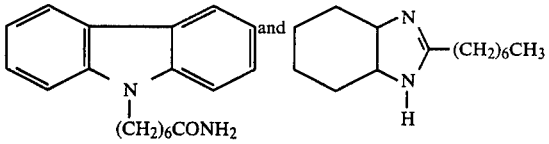

at a proportion of 100 mol:1 mol and at a total concentration of $1\times10^{-3}$ mol/liter was freshly spread over the aqueous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film comprising three monomolecular films of molecules of the above compounds as the second layer on the first layer previously formed.

In the following steps, the above operations for forming the third layer to the second layer were repeated four times, followed finally by lamination of the third layer, to form a luminescent layer No. 12 (layer thickness: about 1600 Å) having 4 interfaces between the first layers and the second layers.

Reference example No. 11

[Formation of the luminescent layer No. 12]

The same substrate as used in Reference example 1 was dipped in the same aqueous phase for formation of a monomolecular film as used in Reference example 1.

Next, the operation for forming a monomolecular film comprising stearic acid in Reference example 8 was repeated three times to form a monomolecular built-up film having three monomolecular layers of stearic acid as the third layer on the electrode layer of the above substrate. Stearic acid remaining on the aqueous phase surface was completely removed from said aqueous phase surface.

Next, this substrate was set at a predetermined position in a vapor deposition chamber in a resistance heating vapor deposition device, further anthracene (m.p. 216° C.) was charged into one resistance heating boat and anthraquinone (m.p. 286° C.) into another boat. After the chamber was first internally evacuated to vacuum pressure of $10^{-6}$ Torr, the current flowing through the boat containing anthraquinone was controlled constantly so that the vapor deposition speed of anthraquinone was 0.1 Å/sec and also the current flowing through the boat containing anthracene was controlled so that the vapor deposition speed of the whole deposited layer comprising a mixture of anthracene and anthraquinone was 2 Å/sec, thereby forming a deposited layer comprising anthracene and anthraquinone of 200 Å thick as the first layer on the insulation layer as the third layer previously formed. During vapor deposition, the vacuum pressure in the tank was maintained at $9\times10^{-6}$ Torr and the temperature of the substrate holder at 20° C.

Subsequently, the substrate having thus formed the first layer thereon was dipped again into the aqueous phase from which remaining stearic acid had completely been removed, 0.5 ml of a chloroform solution containing the compounds:

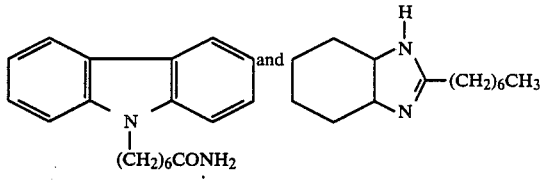

at a proportion of 100 mol:1 mol and at a total concentration of $1\times10^{-3}$ mol/liter was spread over the aqueous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film comprising four monomolecular layer of molecules of the above compounds as the second layer on the first layer previously formed. Then, the substrate was pulled out of the aqueous phase and allowed to stand at room temperature for 30 minutes or longer for drying.

In the following steps, on the second layer thus formed, the operation for forming a monomolecular film comprising stearic acid as described above was repeated four times to form the third layer comprising four monomolecular layers of stearic acid, and the operations for forming the first layer to the third layer were repeated four times to form a luminescent layer No. 12 (layer thickness: about 1600 Å) having four interfaces between the first layers and the second layers.

Reference example 12

[Formation of the luminescent layer No. 13]

The same substrate as used in Reference example 1 was dipped in the same aqueous phase for formation of a monomolecular film as used in Reference example 1.

Next, the operation for forming a monomolecular film comprising stearic acid in Reference example 8 was repeated three times to form a monomolecular built-up film comprising three monomolecular layers of stearic acid as the third layer on the electrode layer of the above substrate. Stearic acid remaining on the aqueous phase surface was completely removed from said aqueous phase surface.

Subsequently, the substrate having the third layer thus formed thereon was dipped again into the aqueous phase from which remaining stearic acid had completely been removed, 0.5 ml of a chloroform solution containing the compounds:

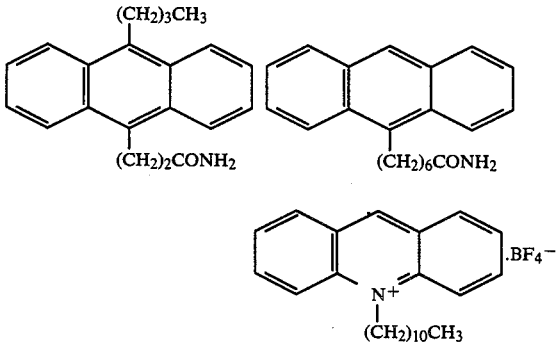

at a proportion of 50 mol:50 mol:1 mol and at a total concentration of $1\times10^{-3}$ mol/liter was spread over the aqueous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film comprising four monomolecular film of molecules of the above compounds as the first layer on the third layer previously formed. Then, the substrate was pulled out of the aqueous phase and allowed to stand at room temperature for 30 minutes or longer for drying.

Next, this substrate was set at a predetermined position in a vapor deposition chamber in a resistance heating vapor deposition device, further carbazole (m.p. 245° C.) was charged into one resistance heating boat and 2,5-diphenyloxazole into another boat. After the chamber was first internally evacuated to vacuum pressure of $10^{-6}$ Torr, the current flowing through the boat containing carbazole was controlled constantly so that the vapor deposition speed of carbazole was 0.4 Å/sec and also the current flowing through the boat containing 2,5-diphenyloxazole was controlled so that the vapor deposition speed of the whole deposited layer comprising a mixture of carbazole and 2,5-diphenyloxazole was 2 Å/sec., thereby forming a deposited layer comprising carbazole and 2,5-diphenyloxazole of 200 Å thick as the second layer on the first layer previously formed. During vapor deposition, the vacuum pressure in the chamber was maintained at $9\times10^{-6}$ Torr and the temperature of the substrate holder at 20° C.

In the following steps, on the second layer thus formed, the operation for forming a monomolecular film comprising stearic acid as described above was repeated twice to form the third layer comprising two built-up layers of the monomolecular film comprising stearic acid, and the operations for forming the first layer to the third layer were repeated four times to form a luminescent layer No. 13 (layer thickness: about 1600 Å) having four interfaces between first layers and the second layers.

Reference example 13

[Formation of the luminescent layer No. 14]

On the same substrate as used in Reference example 1, a vapor deposited layer comprising the methyl stearate layer of 200 Å thick as formed in Reference example 7 was formed as the third layer according to the same method as in Reference example 7.

The sustrate having the third layer formed thereon was dipped in the same aqueous phase for formation of a monomolecular film as employed in Reference example 1.

Next, 0.5 ml of a chloroform solution containing the compounds:

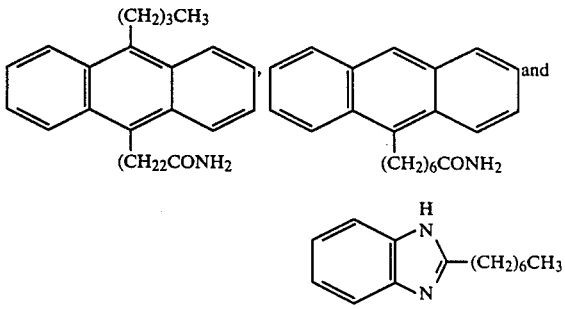

at a proportion of 50 mol:50 mol:1 mol and at a total concentration of $1\times10^{-3}$ mol/liter was spread over the aqueous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film comprising four monomolecular layers of molecules of the above compounds as the first layer on the third layer previously formed. Then, the substrate was pulled out of the aqueous phase and allowed to stand at room temperature for 30 minutes or longer for drying.

Further, the above compounds remaining on the aqueous phase were completely removed, the substrate was dipped into the aqueous phase, and 0.5 ml of a chloroform solution containing the compounds:

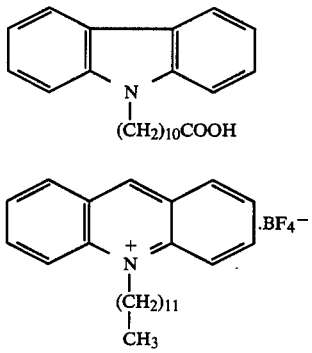

at a proportion of 100 mol:1 mol and at a total concentration of $1\times10^{-3}$ mol/liter was freshly spread over the aqeuous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film comprising four monomolecular layers of molecules of the above compounds as the second layer on the first layer previously formed.

In the following steps, the above operations for forming the third layer to the second layer were repeated four times, followed finally by lamination of the third layer, to form a luminescent layer No. 14 (layer thickness: about 1800 Å) having 4 interfaces between the first layers and the second layers.

Reference example No. 14

[Formation of the luminescent layer No. 15]

The same substrate as used in Reference example 1 was dipped in the same aqueous phase for formation of a monomolecular film as used in Reference example 1.

Next, the operation for forming a monomolecular film comprising stearic acid in Reference example 8 was repeated three times to form a monomolecular built-up film comprising three monomolecular layers of stearic acid as the third layer on the electrode layer of the above substrate. Stearic acid remaining on the aqueous phase surface was completely removed from said aqueous phase surface.

Next, this substrate was set at a predetermined position in a vapor deposition chamber in a resistance heating vapor deposition device, further anthracene (m.p. 216° C.) was charged into one resistance heating boat and indazole (m.p. 145° C.) into another boat. After the chamber was first internally evacuated to vacuum pressure of $10^{-6}$ Torr, the current flowing through the boat containing indazole was controlled constantly so that the vapor deposition speed of indazole was 0.2 Å/sec and also the current flowing through the boat containing anthracene was controlled so that the vapor deposition speed of the whole deposited layer comprising a mixture of anthracene and indazole was 2 Å/sec, thereby forming a deposited layer comprising anthracene and indazole of 200 Å thick as the first layer on the insulating layer as the third layer previously formed. During vapor deposition, the vacuum pressure in the chamber was maintained at $9\times10^{-6}$ Torr and the temperature of the substrate holder at 20° C.

Subsequently, the substrate having the first layer thus formed thereon was dipped again into the aqueous phase from which remaining stearic acid had completely been removed, 0.5 ml of a chloroform solution containing the compounds:

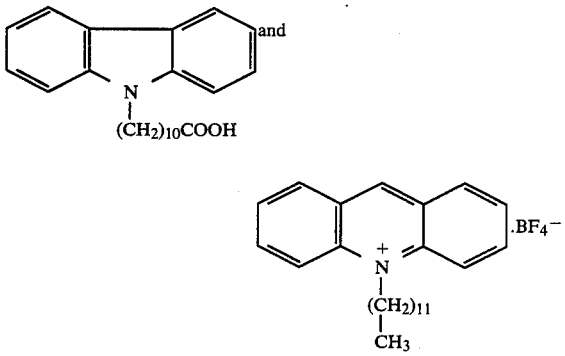

at a proportion of 100 mol:1 mol and at a total concentration of $1\times10^{-3}$ mol/liter was spread over the aqueous phase, the surface pressure was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film having 4 built-up layers of the monomolecular film comprising molecules of the above compounds as the second layer on the first layer previously formed. Then, the substrate was pulled out of the aqueous phase and allowed to stand at room temperature for 30 minutes or longer for drying.

In the following steps, on the second layer thus formed, the operation for forming a monomolecular film comprising stearic acid as described above was repeated four times to form the third layer comprising 4 built-up layers of the monomolecular film comprising stearic acid, and the operations for forming the first layer to the third layer were repeated four times to form a luminescent layer No. 15 (layer thickness: about 1500 Å) having four interfaces between the first layers and the second layers.

Reference example 15

[Formation of the luminescent layer No. 16]

The same substrate as used in Reference example 1 was dipped in the same aqueous phase for formation of a monomolecular film as used in Reference example 1.

Next, the operation for forming a monomolecular film comprising stearic acid in Reference example 8 was repeated three times to form a monomolecular built-up film comprising three monomolecular layers of stearic acid molecules as the third layer on the electrode layer of the above substrate. Stearic acid remaining on the aqueous phase surface was completely removed from said aqueous phase surface.

Subsequently, the substrate having the third layer thus formed thereon was dipped again into the aqueous phase from which remaining stearic acid had completely been removed, 0.5 ml of a chloroform solution containing the compounds:

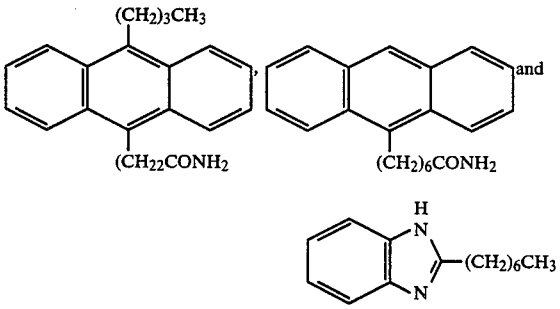

at a proportion of 50 mol:50 mol:1 mol and at a total concentration of $1\times10^{-3}$ mol/liter was spread over the aqueous phase, the surface tension was controlled to 30 dyne/cm, thereby forming a monomolecular film of the above compounds on the aqueous phase, whereupon the substrate was moved up and down quietly at a speed of 2 cm/min. in the direction across the water face twice to have a monomolecular built-up film comprising four monomolecular layers of molecules of the above compounds as the first layer on the third layer previously formed. Then, the substrate was pulled out of the aqueous phase and allowed to stand at room temperature for 30 minutes or longer for drying.

Next, this substrate was set at a predetermined position in a vapor deposition chamber in a resistance heating vapor deposition device, further carbazole (m.p. 245° C.) was charged into one resistance heating boat and anthraquinone (m.p. 286° C.) into another boat. After the chamber was first internally evacuated to vacuum of $10^{-6}$ Torr, the current flowing through the boat containing anthraquinone was controlled constantly so that the vapor deposition speed of anthraquinone was 0.1 Å/sec and also the current flowing through the boat containing carbazole was controlled so that the vapor deposition speed of the whole deposited layer comprising a mixture of carbazole and anthraquinone was 2 Å/sec, thereby forming a deposited layer comprising carbazole and anthraquinone of 200 Å thick as the second layer on the first layer previously formed. During vapor deposition, the vacuum in the chamber was maintained at $9\times10^{-6}$ Torr and the temperature of the substrate holder at 20° C.

In the following steps, on the second layer thus formed, the operation for forming a monomolecular film comprising stearic acid as described above was repeated twice to form the third layer comprising 2 built-up layers of the monomolecular film comprising stearic acid, and the operations for forming the first layer to the third layer were repeated four times to form a luminescent layer No. 16 (layer thickness: about 1500 Å) having four interfaces between the first layers and the second layers.

Reference example 16

[Formation of the luminescent layer No. 17]

On the surface of a 50 mm square glass was formed an I.T.O. layer with a film thickness of 1500 Å according to the sputtering method to provide a substrate for formation of a luminescent layer having a transparent electrode layer, and further an $SiO_2$ film with a film thickness of 1000 Å was formed on said layer according to the sputtering method to give an insulating layer as the third layer.

The substrate was set at a predetermined position in a vapor deposition chamber in a resistance heating vapor deposition device, further triphenylamine (m.p. 127° C.) was charged into the resistance heating boat. After the chamber was first internally evacuated to vacuum pressure of $10^{-6}$ Torr, the current flowing through the boat was controlled so that the vapor deposition speed was 2 Å/sec, and a vapor deposited layer comprising a methyl stearate layer of 200 Å thick was formed as the first layer on the third layer previously formed on the transparent electrode of the above substrate. During vapor deposition, the vacuum pressure in the chamber was maintained at $9\times10^{-6}$ Torr and the temperature of the substrate holder at 20° C.

Next, by use of anthracene (m.p. 216° C.) in place of triphenylamine, according to the same procedure as in formation of the previous first layer, a vapor deposited layer comprising anthracene of 300 Å thick was formed as the second layer on the first layer previously formed.

Further, by use of methyl stearate (m.p. 38° C.) in place of anthracene, a vapor deposited layer comprising methyl stearate of 300 Å thick was formed similarly as in formation of the previous first layer as the new third layer on the second layer previously formed.

In the following steps, the operations for forming the first layer comprising triphenylamine to the third layer comprising methyl stearate as described above were repeated once more to form a luminescent layer No. 17 (layer thickness: about 1800 Å) having two interfaces between the first layers and the second layers.

Reference example 17

[Formation of the luminescent layer No. 18]

On the electrode layer of the same substrate as used in Reference example 1, an $SiO_2$ film with a film thickness of 1000 Å was laminated according to the sputtering method similarly as in Reference example 1 to provide an insulating layer as the third layer.

After the third layer was thus formed, the electrode substrate was set in a vapor deposition chamber, and two resistance heating boats, one containing anthracene (m.p. 216° C.) and the other containing anthraquinone (m.p. 286° C.) were further set in the vapor deposition chamber. After the chamber was first internally evacuated to vacuum of $10^{-6}$ Torr, the current flowing through the boat containing anthraquinone was controlled constantly so that the vapor deposition speed of anthraquinone was 0.1 Å/sec and also the current flowing through the boat containing anthracene was controlled so that the vapor deposition speed of the whole deposited layer comprising a mixture of anthracene and anthraquinone was 2 Å/sec. thereby forming a deposited layer comprising anthracene and anthraquinone of 200 Å thick as the first layer on the insulating layer as the third layer previously formed. During vapor deposition, the vacuum in the tank was maintained at $9\times10^{-6}$ Torr and the temperature of the substrate holder at 20° C.

Further, one of the resistance heating boats was exchanged with one containing triphenylamine (m.p. 245° C.) and the other with one containing indazole (m.p. 145° C.), and said chamber was first evacuated to vacuum of $10^{-6}$ Torr. Then, by setting the current through the resistance heating boat at a value so that the vapor deposition speed of indazole became 0.1 Å/sec, and the current flowing through the boat containing triphenylamine was controlled so that the vapor deposition speed of the whole deposited layer comprising triphenylamine and indazole became 2 Å/sec., to form a vapor deposited layer comprising a mixture of triphenylamine and indazole of 200 Å thick as the second layer on the insulating layer as the third layer. During vapor deposition, the vacuum in the chamber was maintained at $9\times10^{-6}$ Torr and the temperature of the substrate holder at 20° C.

Subsequently, while the substrate was set in the vapor deposition chamber, methyl stearate (m.p. 38° C.) was further charged into the resistance heating boat. After said chamber was internally evacuated to $10^{-6}$ Torr, the current flowing through the resistance heating boat was controlled so that the vapor deposition speed became 2 Å/sec, to form a vapor deposited layer comprising methyl stearate layer of 200 Å thick as the third layer on the second layer previously formed. During vapor deposition, the vacuum in the chamber was maintained at $9\times10^{-6}$ Torr and the temperature of the substrate holder at 20° C.

In the following steps, the above operations for forming the first layer to the third layer were repeated four times to form a luminescent layer No. 18 (layer thickness: about 2400 Å) having 4 interfaces between the first layer and the second layer.

Reference example 18

[Formation of the luminescent layer No. 19]

On the electrode layer of the same substrate as used in Reference example 1, an $SiO_2$ film with a film thickness of 1000 Å was laminated according to the sputtering method similarly as in Reference example 1 to provide an insulating layer as the third layer.

After the third layer was thus formed, the electrode substrate was set in a vapor deposition chamber, and two resistance heating boats, one containing triphenylamine (m.p. 127° C.) and the other containing anthraquinone (m.p. 286° C.) were further set in the vapor deposition chamber. After the chamber was first internally evacuated to vacuum of $10^{-6}$ Torr, the current flowing through the boat containing anthraquinone was controlled constant so that the vapor deposition speed of anthraquinone was 0.1 Å/sec and also the current flowing through the boat containing triphenylamine was controlled so that the vapor deposition speed of the whole deposited layer comprising a mixture of triphenylamine and anthraquinone was 2 Å/sec, thereby forming a deposited layer comprising triphenylamine and anthraquinone of 200 Å thick as the first layer on the insulating layer as the third layer previously formed. During vapor deposition, the vacuum in the chamber was maintained at $9\times10^{-6}$ Torr and the temperature of the substrate holder at 20° C.

Further, one of the resistance heating boats was exchanged with one containing anthracene (m.p. 216° C.) and the other with one containing indazole (m.p. 145° C.), and said chamber was first evacuated to vacuum of $10^{-6}$ Torr. Then, by setting the current through the resistance heating boat at a constant value so that the vapor deposition speed of indazole became 0.1 Å/sec, and the current flowing through the boat containing anthracene was controlled so that the vapor deposition speed of the whole deposited layer comprising anthracene and indazole became 2 Å/sec, to form a vapor deposited layer comprising a mixture of triphenylamine and indazole of 200 Å thick as the second layer on the insulating layer as the third layer. Also, in this case, during vapor deposition, the vacuum in the chamber was maintained at $9\times10^{-6}$ Torr and the temperature of the substrate holder at 20° C.

Subsequently, while the substrate was set in the vapor deposition chamber, methyl stearate (m.p. 38° C.) was further charged into the resistance heating boat. After said chamber was internally evacuated to $10^{-6}$ Torr, the current flowing through the resistance heating boat was controlled so that the vapor deposition speed became 2 Å/sec, to form a vapor deposited layer comprising methyl stearate layer of 200 Å thick as the third layer on the second layer previously formed. Also, in this case, during vapor deposition, the vacuum in the chamber was maintained at $9\times10^{-6}$ Torr and the temperature of the substrate holder at 20° C.

In the following steps, the above operations for forming the first layer to the third layer were repeated four times to form a luminescent layer No. 19 (layer thickness: about 2400 Å) having 4 interfaces between the first layer and the second layer.

EXAMPLE 1

Formation of an EL device of the present invention having a structure as shown in FIG. 1 was practiced as follows.

On the surface of a 50 mm square glass, a transparent electrode layer 1 was formed by vapor deposition of an I.T.O. layer with a thickness of 1500 Å according to the sputtering method.

Next, on the transparent electrode 1, either one of the luminescent layers (No. 17–No. 19) formed in Reference examples 16 to 18 was formed as the luminescent layer 4, and the substrate having the luminescent layer 4 formed was set at a predetermined position in the vacuum deposition chamber in a vacuum deposition device, and the chamber was once internally evacuated to $1\times10^{-6}$ Torr. Then, the vacuum pressure in said chamber was controlled to $9\times10^{-6}$ Torr and an Au layer with a thickness of 50 Å was formed at a vapor deposition speed of 5 Å/sec on the third layer positioned at the top of the luminescent layer 4, thus providing a translucent electrode layer 3.

Further, on the translucent electrode layer 3, either one of the luminescent layers (No. 1–No. 16) formed in Reference examples 1 to 15 was formed as the luminescent layer 5 having a monomolecular film or a monomolecular built-up film, and then the substrate having this luminescent layer 5 formed thereon was set at a predetermined position in the vapor deposition chamber in a vacuum vapor deposition device. After said chamber was evacuated internally once to $10^{-6}$ Torr, the vacuum pressure in said chamber was this time controlled to $1\times10^{-5}$ Torr, and an Al layer with a thickness of 1500 Å as a translucent back electrode 2 was formed at a vapor deposition speed of 20 Å/sec on the third layer positioned at the top of the luminescent layer 5. The 48 pieces of EL device of the present invention which were prepared comprised a combination of the above-mentioned translucent back electrode 2, the luminescent layer 4 selected from those of No. 1 to No. 16 and the luminescent layer 5 selected from those of No. 17 to No. 19.

Figure 5:
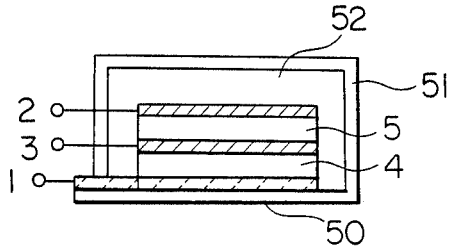
FIG. 5 is a schematic sectional view of an EI cell having the EL device of the present invention.

Each of these EL devices of the present invention was sealed with a seal glass 51 as shown in FIG. 5, and silicone oil 52 purified, degassed and dehydrated in a conventional manner was injected into the seal to form an EL cell 50.

For each of the EL cells, alternate current voltage (20 V, 400 Hz) was applied between the electrode layers 1 and 3 and between the electrode layers 2 and 3 to effect luminescence, and the luminance and current density in luminescence were measured. As the result, current density within the range from 0.08 to 0.13 mA and luminance within the range from 20 to 40 fL were measured.

EXAMPLE 2

Formation of an EL device of the present invention having a structure as shown in FIG. 1 was practiced as follows.

On the surface of a 50 mm square glass, a transparent electrode layer 1 was formed by vapor deposition of an I.T.O. layer with a thickness of 1500 Å according to the sputtering method.

Next, on the transparent electrode 1, either one of the luminescent layers (No. 1–No. 16) formed in Reference examples 1 to 15 was formed as the luminescent layer 4, and the substrate having the luminescent layer 4 formed was set at a predetermined position in the vacuum deposition chamber in a vacuum deposition device, and the chamber was first internally evacuated to $1\times10^{-6}$ Torr. Then, the vacuum in said chamber was controlled to $9\times10^{-6}$ Torr and an Au layer with a thickness of 50 Å was formed at a vapor deposition speed of 5 Å/sec on the third layer positioned at the top of the luminescent layer 4, thus providing a translucent electrode layer 3.

Further, on the translucent electrode layer 3, either one of the luminescent layers (No. 1–No. 16) formed in Reference examples 1 to 15 was formed as the luminescent layer 5 having a monomolecular film or a monomolecular built-up film, and then the substrate having this luminescent layer 5 formed thereon was set at a predetermined position in the vapor deposition chamber in a vacuum vapor deposition device. After said chamber was evacuated internally once to $10^{-6}$ Torr, the vacuum pressure in said chamber was this time controlled to $1\times10^{-5}$ Torr, and an Al layer with a thickness of 1500 Å as a translucent back electrode 2 was formed at a vapor deposition speed of 20 Å/sec on the third layer positioned at the top of the luminescent layer 5. The 256 pieces of EL device of the present invention which were prepared comprised a combination of the above-mentioned translucent back electrode 2 and the luminescent layers 4 and 5 selected from those of No. 1 to No. 16.

Each of these EL devices of the present invention was sealed with a seal glass 51 as shown in FIG. 5, and silicone oil 52 purified, degassed and dehydrated in a conventional manner was injected into the seal to form an EL cell 50.

For each of the EL cells, alternate current voltage (20 V, 400 Hz) was applied between the electrode layers 1 and 3 and between the electrode layers 2 and 3 to effect luminescence, and the luminance and current density in luminescence were measured. As the result, current density within the range from 0.08 to 0.13 mA and luminance within the range from 20 to 40 fL were measured.

We claim:

1. An electroluminescent device comprising in sequence a first electrode, a first luminescent layer provided on said first electrode, a second electrode, a second luminescent layer, and a third electrode, wherein each of said luminescent layers includes a first layer of an electron-accepting organic compound, a second layer of an electron-donating organic compound, wherein at least one of said first layer and said second layer in said first luminescent layer and said second luminescent layer is selected from the group consisting of a Langmuir-Blodgett monomolecular film or a built-up film thereof.

2. An electroluminescent device according to claim 1, wherein said organic compound has a high luminescent quantum efficiency, has a $\pi$ electron system susceptible to external perturbation and is a compound which can easily be excited by electrical field.

3. An electroluminescent device according to claim 1, wherein said organic compound is fused polycyclic aromatic hydrocarbon, p-terphenyl, 2,5-diphenyloxazole, 1,4-bis(2-methylstyryl)-benzene, xanthine, coumarin, acridine, cyanine dye, benzophenone, phthalocyanine and metal complex thereof, porphyrine and metal complex thereof, 8-hydroxyquinoline and metal complex thereof, organic ruthenium complex, organic rare-earth complex and derivatives of these compounds, heterocyclic compounds and derivatives thereof, aromatic amine, aromatic polyamine, compounds having quinone structure, tetracyanoquinodimethane tetracyanoethylene and derivatives of these compounds.

4. An electroluminescent device according to claim 1, wherein said first and second luminescent layers have the same function.

5. An electroluminescent device according to claim 1, wherein said first and second luminescent layers have different functions.

6. An electroluminescent device according to claim 1, wherein each of the compounds capable of being an electron acceptor or an electron-donor to said organic compound is selected from heterocyclic compounds, aromatic amines, aromatic polyamines, quinone-structure-having compounds, tetracyanoquinodimethane, tetracyanoethylene, and derivatives thereof.

7. An electroluminescent device according to claim 1 wherein each of the first layer and the second layer is not more than 500 A in thickness.

8. An electroluminescent device according to claim 1, wherein at least said first or said third electrode is transparent.

9. An electroluminescent device according to claim 8, wherein said second electrode is transparent or translucent.

10. An electroluminescent device according to claim 1, wherein all of said first layers and said second layers in said first luminescent layer and said second luminescent layer are selected from the group consisting of a Langmuir-Blodgett monomolecular film or a built-up film thereof.

11. An electroluminescent device comprising in sequence a first electrode, a first luminescent layer provided on said first electrode, a second electrode, a second luminescent layer, and a third electrode, wherein each of said luminescent layers includes a first layer of an electron-accepting organic compound, a second layer of an electron-donating organic compound, and a third layer having an electrical insulating property, and at least one of said first layers, said second layers and said third layers in said first luminescent layer and said second luminescent layer is selected from the group consisting of a Langmuir-Blodgett monomolecular film or a built-up film thereof.

12. An electroluminescent device according to claim 11, wherein said organic compound has a high luminescent quantum efficiency, has an $\pi$ electron system susceptible to external perturbation and is a compound which can easily be excited by electrical field.

13. An electroluminescent device according to claim 11, wherein said organic compound is a fused polycyclic aromatic hydrocarbon, p-terphenyl, 2,5-diphenyloxazole, 1,4-bis(2-methylstyryl)-benzene, xanthine, coumarin, acridine, cyanine dye, benzophenone, phthalocyanine and a metal complex thereof, prophyrine and a metal complex thereof, 8-hydroxyquinoline and a metal complex thereof, organic ruthenium complex, organic rare-earth complex and derivatives of said compounds, heterocyclic compounds and derivatives thereof, aromatic amine, aromatic polyamine, compounds having a quinone structure, tetracyanoquinodimethane, tetracyanoethylene, and derivatives of said compounds.

14. An electroluminescent device according to claim 11, wherein said first and second luminescent layers have the same function.

15. An electroluminescent device according to claim 11, wherein said first and second luminescent layers have the different functions.

16. An electroluminescent device according to claim 11, wherein each of the compounds capable of being an electron acceptor or an electron-donor to said organic compound is selected from the group consisting of heterocyclic compounds, aromatic amines, aromatic polyamines compounds having a quinone structure, tetracyanoquinodimethane, tetracyanoethylene, and derivatives thereof.

17. An electroluminescent device according to claim 11, wherein each of the first layer and the second layer, and the third layer is not more than 500 A in thickness.

18. An electroluminescent device according to claim 11, wherein at least said first or said third electrode is transparent.

19. An electroluminescent device according to claim 11, wherein said second electrode is transparent or translucent.

20. An electroluminescent device according to claim 11, wherein all of said first layers, said second layers, and said third layers in said first luminescent layer and said second luminescent layer are selected from the group consisting of a Langmuir-Blodgett monomolecular film or a built-up film thereof.

21. An electroluminescent device comprising in sequence a first electrode, a first luminescent layer provided on said first electrode, a second electrode, a second luminescent layer, and a third electrode; wherein each of said luminescent layers includes a first layer of a relatively electron-acceptable organic compound and a compound capable of being an electron-donor or an electron acceptor relative to said electron-acceptable organic compound, a second layer of a relatively electron-donative organic compound and a compound capable of being an electron-donor or an electron-acceptor to said electron-donative organic compound; wherein at least one of said first layers and said second layers in said first luminescent layer and said second luminescent layer is selected from the group consisting of a Langmuir-Blodgett monomolecular film or a built-up film thereof.

22. An electroluminescent device according to claim 21, wherein said organic compound has a high luminescent quantum efficiency, has a $\pi$ electron system susceptible to external perturbation and is a compound which can easily be excited by electrical field.

23. An electroluminescent device according to claim 21, wherein said organic compound is a fused polycyclic aromatic hydrocarbon, p-terphenyl, 2,5-diphenyloxazole, 1,4-bis(2-methylstyryl)-benzene, xanthine, coumarin, acridine, cyanine dye, benzophenone, phthalocyanine and metal complex thereof, prophyrine and a metal complex thereof, 8-hydroxyquinoline and a metal complex thereof, organic ruthenium complex, organic rare-earth complex and derivatives of said compounds, heterocyclic compounds and derivatives thereof, aromatic amine, aromatic polyamine, compounds having a quinone structure, tetracyanoquinodimethane, and tetracyanoethyelene, and derivatives of said compounds.

24. An electroluminescent device according to claim 21, wherein said first and second luminescent layers have the same function.

25. An electroluminescent device according to claim 21, wherein said first and second luminescent layers have different functions.

26. An electroluminescent device according to claim 21, wherein each of the compounds capable of being an electron acceptor or an electron-donor to said organic compound is selected from the group consisting of heterocyclic compounds, aromatic amines, aromatic polyamines, compounds having a quinone structure tetracyanoquinodimethane, tetracyanoethyelene, and derivatives thereof.

27. An electroluminescent device according to claim 21, wherein each of the first layer and the second layer, is not more than 500 A in thickness.

28. An electroluminescent device according to claim 21, wherein at least said first or said third electrode is transparent.

29. An electroluminescent device according to claim 21, wherein said second electrode is transparent or translucent.

30. An electroluminescent device according to claim 21, wherein all of said first layers and said second layers in said first luminescent layer and said second luminescent layer are selected from the group consisting of a Langmuir-Blodgett monomolecular film or a built-up film thereof.

31. An electroluminescent device comprising in sequence a first electrode, a first luminescent layer provided on said first electrode, a second electrode, a second luminescent layer, and a third electrode; wherein each of said luminescent layers includes a first layer of a relatively electron-acceptable organic compound and a compound capable of being an electron-donor or an electron acceptor relative to said electron-acceptable organic compound, a second layer of a relatively electron-donative organic compound and a compound capable of being an electron-donor or an electron-acceptor to said electron-donative organic compound; and a third layer having an electrical insulating property, and at least one of said first layers, said second layers, and said third layers in said first luminescent layer and said second luminescent layer is selected from the group consisting of a Langmuir-Blodgett monomolecular film or a built-up film thereof.

32. An electroluminescent device according to claim 31, wherein said organic compound has a high luminescent quantum efficiency, has a $\pi$ electron system susceptible to external perturbation and is a compound which can easily be excited by electrical field.

33. An electroluminescent device according to claim 31, wherein said organic compound is a fused polycyclic aromatic hydrocarbon, p-terphenyl, 2,5-diphenyloxazole, 1,4-bis(2-methylstyryl)-benzene, xanthine, coumarin, acridine, cyanine dye, benzophenone, phthalocyanine and a metal complex thereof, porphyrine and a metal complex thereof, 8-hydroxyquinoline and a metal complex thereof, organic ruthenium complex, organic rare-earth complex and derivatives of said compounds, heterocyclic compounds and derivatives thereof, aromatic amine, arometic polyamine, compounds having a quinone structure, tetracyanoquinodimethane, tetracyanoethyelene, and derivatives of said compounds.

34. An electroluminescent device according to claim 31, wherein said first and second luminescent layers have the same function.

35. An electroluminescent device according to claim 31, wherein said first and second luminescent layers have different functions.

36. An electroluminescent device according to claim 31, wherein each of the compounds capable of being an electron acceptor or an electron-donor to said organic compound is selected from the group consisting of heterocyclic compounds, aromatic amines, aromatic polyamines, compounds having a quinone structure, tetracyanoquinodimethane, tetracyanoethyelene, and derivatives thereof.

37. An electroluminescent device according to claim 31, wherein each of the first layer, the second layer, and the third layer is not more than 500 A in thickness.

38. An electroluminescent device according to claim 31, wherein at least said first or said third electrode is transparent.

39. An electroluminescent device according to claim 31, wherein said second electrode is transparent or translucent.

40. An electroluminescent device according to claim 31, wherein all of said first layers, said second layers, and said third layers in said first luminescent layer and said second luminescent layer are selected from the group consisting of a Langmuir-Blodgett monomolecular film or a built-up film thereof.

41. An electroluminescent device comprising in sequence a first electrode, a first luminescent layer provided on said first electrode, a second electrode, a second luminescent layer, and a third electrode; wherein one of said luminescent layers includes at least a first layer of an electron-accepting organic compound and a second layer comprising an electron-donating organic compound, and the other of said luminescent layers includes at least a first layer of a relatively electron-acceptable organic compound and a compound capable of being an electron-donor or an electron acceptor relative to said electron-acceptable organic compound, a second layer of a relatively electron-donative organic compound and a compound capable of being an electron-donor or an electron-acceptor to said electron-donative organic compound, and at least one of said first layers and said second layers in said first luminescent layer and said second luminescent layer is selected from the group consisting of a Langmuir-Blodgett monomolecular film or a built-up film thereof.

42. An electroluminescent device according to claim 41, wherein said organic compound has a high luminescent quantum efficiency, has a $\pi$ electron system susceptible to external perturbation and is a compound which can easily be excited by electrical field.

43. An electroluminescent device according to claim 41, wherein said organic compound is a fused polycyclic aromatic hydrocarbon, p-terphenyl, 2,5-diphenyloxazole, 1,4-bis(2-methylstyryl)-benzene, xanthine, coumarin, acridine, cyanine dye, benzophenone, phthalocyanine and a metal complex thereof, porphyrine and a metal complex thereof, 8-hydroxyquinoline and a metal complex thereof, organic ruthenium complex, organic rare-earth complex and derivatives of said compounds, heterocyclic compounds and derivatives thereof, aromatic amine, aromatic polyamine, compounds having a quinone structure, tetracyanoquinodimethane, tetracyanoethyelene, and derivatives of said compounds.

44. An electroluminescent device according to claim 41, wherein said first and second luminescent layers have the same function.

45. An electroluminescent device according to claim 41, wherein said first and second luminescent layers have different functions.

46. An electroluminescent device according to claim 41, wherein each of the compounds capable of being an electron acceptor or an electron-donor to said organic compound is selected from the group consisting of heterocyclic compounds, aromatic amines, aromatic polyamines, compounds having a quinone structure, tetracyanoquinodimethane, tetracyanoethyelene, and derivatives thereof.

47. An electroluminescent device according to claim 41, wherein each of the first layer and the second layer, is not more than 500 A in thickness.

48. An electroluminescent device according to claim 41, wherein at least said first or said third electrode is transparent.

49. An electroluminescent device according to claim 41, wherein said second electrode is transparent or translucent.

50. An electroluminescent device according to claim 41, wherein all of said first layers and said second layers in said first luminescent layer and said second luminescent layer are selected from the group consisting of a Langmuir-Blodgett monomolecular film or a built-up film thereof.

* * * * *

UNITED STATES PATENT AND TRADEMARK OFFICE

CERTIFICATE OF CORRECTION

PATENT NO. : 4,741,976

DATED : May 3, 1988

INVENTOR(S) : KEN EGUCHI, ET AL.

It is certified that error appears in the above-identified patent and that said Letters Patent is hereby corrected as shown below:

COLUMN 1

Lines 51-52, "the materials" should read --the presently known materials--.

COLUMN 3

Line 7, "EI" should read --EL--.

COLUMN 40

Line 61, "$(CH_{22}CONH_2$" should read --$(CH_2)_2CONH_2$--.

COLUMN 48

Line 33, "tetracyanoquinodimethane" should read --tetracyanoquinodimethane,--.
Line 50, "500 A" should read --500 Å--.

COLUMN 49

Line 10, "an π" should read --a π--.
Line 32, "the" should be deleted.
Line 38, "amines" should read --amines,--.
Line 43, "500 A" should read --500 Å--.

UNITED STATES PATENT AND TRADEMARK OFFICE

CERTIFICATE OF CORRECTION

PATENT NO. : 4,741,976

DATED : May 3, 1988

INVENTOR(S) : KEN EGUCHI, ET AL.

It is certified that error appears in the above-identified patent and that said Letters Patent is hereby corrected as shown below:

COLUMN 50

Line 22, "racyanoethyelene," should read --racyanoethylene,--.
Line 34, "structure" should read --structure,--.
Line 35, "tetracyanoethyelene," should read --tetracyanoethylene,--.
Line 38, "layer," should read --layer--.
Line 39, "500 A" should read --500 Å--.

COLUMN 51

Line 18, "arometic" should read --aromatic--.
Line 20, "racyanoethyelene," should read --racyanoethylene,--.
Line 33, "tetracyanoethyelene," should read --tetracyanoethylene,--.
Line 37, "500 A" should read --500 Å--.

COLUMN 52

Line 28, "racyanoethyelene," should read --racyanoethylene,--.
Line 41, "tetracyanoethyelene," should read --tetracyanoethylene,--.
Line 44, "layer," should read --layer--.
Line 45, "500 A" should read --500 Å--.

UNITED STATES PATENT AND TRADEMARK OFFICE

CERTIFICATE OF CORRECTION

PATENT NO. : 4,741,976

DATED : May 3, 1988

INVENTOR(S) : KEN EGUCHI, ET AL.

It is certified that error appears in the above-identified patent and that said Letters Patent is hereby corrected as shown below:

COLUMN 43

Line 21, "$(CH_{22}CONH_2$" should read --$(CH_2)_2CONH_2$--.

Signed and Sealed this

Thirty-first Day of January, 1989

*Attest:*

DONALD J. QUIGG

*Attesting Officer*

*Commissioner of Patents and Trademarks*